US005100697A

United States Patent [19]

Nielsen

[11] Patent Number: 5,100,697

[45] Date of Patent: Mar. 31, 1992

[54] METHOD FOR IMPROVING THE RELEASE OF A MOULDED CONCRETE BODY FROM THE MOULD

[75] Inventor: Erik Nielsen, Greve Strand, Denmark

[73] Assignee: Castrol A/S, Copenhagen, Denmark

[21] Appl. No.: 201,311

[22] Filed: May 26, 1988

Related U.S. Application Data

[63] Continuation of Ser. No. 821,731, Dec. 30, 1985, abandoned.

[30] Foreign Application Priority Data

May 1, 1984 [DK] Denmark ..... 2169/84

[51] Int. Cl.[5] ..... B05D 3/10

[52] U.S. Cl. ..... 427/133; 427/134

[58] Field of Search ..... 106/38.22, 38.24, 12, 106/243, 244; 252/312; 427/133, 134

[56] References Cited

U.S. PATENT DOCUMENTS

| | | | |
|---|---|---|---|
| 2,976,160 | 3/1961 | Fronczak et al. | 106/38.24 |
| 3,213,024 | 10/1965 | Blake et al. | 106/38.22 |
| 3,222,201 | 12/1965 | Boyle et al. | 252/312 |
| 3,354,180 | 11/1967 | Ekiss et al. | 427/135 |
| 3,404,991 | 10/1968 | Taylor et al. | 252/312 |
| 3,506,463 | 4/1970 | Holzinger et al. | 106/38.24 |
| 3,524,751 | 8/1970 | Smith | 106/244 |
| 3,929,499 | 12/1975 | Thomas | 106/38.24 |
| 3,975,294 | 8/1976 | Dumoulin | 252/312 |
| 4,097,403 | 6/1978 | Tsutsumi et al. | 252/312 |
| 4,265,264 | 5/1981 | Sifferman | 252/312 |
| 4,348,954 | 9/1982 | Okishi | 101/465 |
| 4,396,635 | 8/1983 | RoudeBush et al. | 426/554 |
| 4,454,113 | 6/1984 | Hemker | 252/312 |
| 4,592,859 | 6/1986 | Smith-Johannsen | 252/309 |
| 4,609,570 | 9/1986 | Couleau | 427/135 |

FOREIGN PATENT DOCUMENTS

| | | |
|---|---|---|
| 2925485 | 1/1980 | Fed. Rep. of Germany . |
| 2204678 | 6/1974 | France . |
| 134715 | 12/1974 | Japan . |
| 048162 | 12/1976 | Japan . |
| 162608 | 12/1981 | Japan . |
| 670443 | 6/1979 | U.S.S.R. . |

OTHER PUBLICATIONS

McCutcheon's *Detergents and Emulsifiers*, No. American ed., 1978, p. 192.

*Primary Examiner*—Janyce Bell

*Attorney, Agent, or Firm*—Birch, Stewart, Kolasch & Birch

[57] ABSTRACT

The release of a moulded concrete body from the mould can be improved by applying, to the mould, an effective amount of a concrete release composition in the form of an oil-in-water emulsion in which the oily phase is at least one of the following: a mineral oil with a content of aromatics of at most 9%, a vegetable oil and one or more oily esters of aliphatic carboxylic acids with mono- or dihydric alcohols and having a melting point of at the most 35° C., the total number of carbon atoms in the esters being 8–46, and comprising one or more non-ionic surfactants in an amount of 0.5–20% by weight and one or more anionic surfactants in an amount of 1–100%, based on the non-ionic surfactant. The emulsion may also comprise cationic surfactants, anti-freeze, stabilizers, corrosion inhibitors, etc. The oily esters of aliphatic carboxylic acids with mono- or dihydric alcohols may also be used in non-emulsified form.

32 Claims, No Drawings

METHOD FOR IMPROVING THE RELEASE OF A MOULDED CONCRETE BODY FROM THE MOULD

This application is a continuation of application Ser. No. 821,731 filed on Dec. 30, 1985, now abandoned.

BRIEF DESCRIPTION OF THE INVENTION

The present invention relates to a method for improving the release of a moulded concrete body from the mould by applying an effective amount of a concrete release composition to the mould. The composition is an oil-in-water emulsion containing water in an amount of 10–90% by weight, an oily component in an amount of 10–90% by weight, one or more non-ionic surfactants in an amount of 0.5–20% by weight of the total emulsion, and one or more anionic surfactants provided as a sodium, potassium, lithium, ammonium or a lower alkylamine, lower alkyl-alkanolamine or lower alkanolamine salt of at the most 8 carbon atoms or a mixed salt, in which the amount of anionic surfactant in relation to the non-ionic surfactant is 1–100% by weight, or the concrete release composition comprises one or more oily esters of aliphatic carboxylic acids with mono- or dihydric alcohols, the total number of carbon atoms in the esters being 8–46, optionally in admixture with other additives such as mineral oils, triglycerides with 10–24 carbon atoms in each fatty acid moiety, glycols, glycol ethers, alkanols, emulsifiers and water. Furthermore, the present invention relates to the oil-in-water emulsions per se.

BACKGROUND OF THE INVENTION

In order to allow the mould to be released from a moulded concrete body when the concrete body has been fully or partially set, it is necessary to apply a release composition to the mould before the moulding process, i.e. before the concrete composition is poured into the mould. The action of a concrete release agent is partly based on the principle that the curing of the concrete surface is delayed or even prevented so that the concrete body does not adhere to the surface of the mould. The delay in curing or the prevention of curing must only apply to a very thin layer of the concrete body so that the strength of the concrete body is not affected or is only affected to a minor extent.

Such compositions must fulfil various demands, i.e. they must be able to adhere to a certain amount to the mould, they must impart a retarding influence to the surface layer of the concrete, they must have a suitable viscosity index so that they can be sprayed on the surface of the mould both in winter and in summer temperatures, and they should have a minimum effect on the environment.

Another way of obtaining a release ability is to apply a hydrophobic release composition so that the cured concrete will not adhere to the mould.

The release compositions used previously were normally based on mineral oils, and as additives there were normally used kerosene to act as a viscosity decreasing agent, retarding agents for improving the release properties, and other additives which may be wetting agents, adhesives and corrosion-protective agents. Normally, known release compositions contain 65–99% by weight of mineral oil and kerosene and 1–35% by weight of additives. A preferred oil component is spindle oil having a viscosity of about 20 $mm^2$/sec. (CSt) at 40° C. The kerosene used will normally have a boiling point of 150–200° C.

However, it is well-known that the use of mineral oils involves a health risk causing toxic and allergic exzema, skin irritation and skin cancer, and when used in sprayed form, the mineral oils may cause lung diseases. In addition to the health risks connected with the use of mineral oils per se, there is also an environmental disadvantage as mineral oils are normally only slightly biodegradable. Therefore, the widespread use of mineral oils as concrete release agents involves a considerable risk of pollution.

It has been suggested to use vegetable oils to wholly or partially substitute mineral oils in concrete release agents. German Offenlegungsschrift No. 2,253,497 describes a mixture for use in demoulding concrete and plaster comprising a mineral oil and/or a hydrocarbon and at least one glyceride and additionally comprising a surfactant derived from a vegetable or animal fat. The use of surfactants permits the formation of a thin uniform film. The effect of glycerides is to form calcium salts or calcium-containing soaps which are only slightly soluble in water and prevent the curing of the concrete. However, glycerides are often too reactive (they have too strong a curing-preventing activity) to be used in mould release agents as it is difficult to modify their release properties. Hence, glycerides will often yield a porous surface layer caused by the prevention of curing in the outer layer. The use of glycerides is furthermore restricted by their high viscosity. Glycerides of higher saturated fatty acids are high-melting so that they will at normal temperatures separate from solutions based on mineral oils. So in spite of their harmlessness and their bio-degradability, their use is limited.

In order to impart low viscosity to release agents comprising mineral oils and/or vegetable oils, solvents were normally added. A suitable viscosity for applying mould release agents on moulds is in the range of $\leqq 35$ cP at 20° C.

Japanese Patent Application No. 50-97840 (Nippon Seikiyu K.K. and Mitsuo) discloses mixtures of free fatty acids and esters thereof which are used as retarding agents in release oils on a mineral oil basis. The oily agent (the fatty acids and esters) and the mineral oil are used in a weight ratio of 1:1–20, the oily agent containing (a) 50–96% by weight of at least one component selected from $C_{12-20}$ saturated and $C_{18-22}$ unsaturated fatty acids and (b) 50–4% by weight of at least one component selected from fatty acid esters of $C_{12-20}$ saturated and $C_{18-22}$ unsaturated fatty acids with $C_{1-18}$ monovalent alcohols. Hence, the retarding agent comprises at least 50% by weight of a mineral oil and at the most 25% by weight of a fatty acid ester.

In the Japanese application, it is described that combinations of certain fatty acids and certain esters in combination with a mineral oil, provide advantageous effects as mould release agents. Specifically, the methyl ester of bovine fatty acid in admixture with a mineral oil is described as a comparison. However, methyl esters of fatty acids are in fact characterized by their very strong retarding effect so that the esters, when added in only small amounts, increase the release effect of the mineral oil, but cannot substitute the mineral oil.

DESCRIPTION OF THE INVENTION

It has now been found that a mould release composition in the form of an oil-in-water emulsion containing water in an amount of 10–90% by weight of the total emulsion, an oily component in an amount of 10–90% by weight of the total emulsion, one or more non-ionic surfactants in an amount of 0.5–20% by weight of the total emulsion, and one or more anionic surfactants provided as a sodium, potassium, lithium, ammonium or a lower alkylamine, lower alkyl-alkanolamine or lower alkanolamine salt of at the most 8 carbon atoms or a mixed salt, in which the amount of the anionic surfactant in relation to the non-ionic surfactant is 1–100% by weight, and compositions in non-emulsified form comprising one or more esters of aliphatic carboxylic acids with mono- or dihydric alcohols, the total number of carbon atoms in the esters being 8–46, and having a melting point of at most 35° C., in an amount of 26–100% by weight, especially 50–100% by weight, preferably 70–100% by weight, calculated on the basis of the total release composition used, optionally in admixture with additives such as mineral oils, chlorinated oils, glycols, glycol ethers, alkanols, emulsifiers and/or water, imparts excellent release properties to the mould and, furthermore, have several advantages compared to known mould release compositions.

When emulsions of oily substances are formed, three types of emulsions are possible, i.e. oil-in-water emulsions, water-in-oil emulsions and microemulsions (microemulsions are finely dispersed and translucent).

So that the release composition can bind efficiently to the mould, it would be advantageous if the water were incorporated into the oil so as to form a water-in-oil emulsion. However, the usefulness of such emulsions is limited because the application of the emulsion on the mould is extremely difficult. The viscosity of the emulsion will increase along with the increase in the amount of the emulsified water, and therefore, the applied amount will increase. At the same time, there will be a tendency for the emulsion to become less viscous after the spreading as the water evaporates, and thus, it will have a tendency to run off from inclined and vertical surfaces.

Release oils which are formulated as water-in-oil emulsions will therefore have a limited usefulness.

Oil-in-water emulsions may be prepared as low-viscous compositions. However, they usually have a poor adhesion to the mould so that they are torn off at the filling of concrete. It has now surprisingly been found that oil-in-water emulsions may be prepared in such a way that after application on the mould, the emulsion gradually changes its structure so as to be converted into an oily film or a water-in-oil emulsion as the water evaporates. Then the emulsion adheres strongly to the mould so that the emulsion in a dosage of 10–100 g/m$^2$, preferably 15–70 g/m$^2$, and especially 20–50 g/m$^2$, after a drying period of 2–20 minutes, depending on the temperature, and at a relative humidity of about 40–70%, is converted into an adhering oily film or emulsion of the water-in-oil type which will not easily be washed off when rinsing with water or rubbed off at the filling of the concrete mixture.

When the emulsion has been converted, it will be reasonably resistent to rain, which is an important feature when moulding outdoors.

As the oily component in the emulsion, it is possible to use a mineral oil or a mixture of more mineral oils; a triglyceride with 10–24 carbon atoms in each fatty acid moiety, optionally in admixture with a mineral oil; one or more esters of an aliphatic carboxylic acid with a mono- or dihydric alcohol, having melting points below 35° C., preferably below 25° C. and especially below 15° C., the total number of carbon atoms in the esters being 8–46, especially 10–38, preferably 12–30; a mixture of mineral oil(s) and esters as mentioned above, optionally also comprising a triglyceride with 10–24 carbon atoms in each fatty acid moiety, in which the content of ester is 1–100%, especially 10–100%, and preferably 35–100%.

The esters to be used as oily components in the concrete release compositions are defined in detail below.

Emulsions formulated with a mixture of esters as defined above and mineral oil will generally be more stable when the emulsified oily phase consists of a mixture of mineral oil and ester as defined above in a mixing ratio of from 1:2 to 2:1, by weight.

The oily phase in the emulsion may also consist of mixtures of triglycerides with 10–24 carbon atoms in each fatty acid moiety and/or mineral oil and/or one or more esters as defined above and below. Chlorinated oils, polyglycols. $C_{10-20}$ fatty alchols and other oily components may be used as additional oily components.

Examples of triglycerides with 10–24 carbon atoms in each fatty acid moiety are vegetable oils and marine oils.

When the oily component is a mineral oil, it is preferred that this oil comprises at most 9% of aromatics, more preferred, at most 5% and especially at most 2% of aromatics, because contents of aromatics, because of their toxicity, should be kept as low as possible. Preferred mineral oils have a boiling point of at least 250° C.

If the oily component is a mixture of mineral oil(s) and a vegetable oil or marine oil, a preferred ratio between mineral oil and vegetable oil or marine oil is from 99:1 to 50:50.

It is preferred that the content of oily component in the emulsion is 15–75%, preferably 25–55%, by weight of the total emulsion.

The oil-in-water emulsion may be prepared by mixing common tap water in an amount of 10–90% by weight, preferably 20–80% by weight and especially 30–65% by weight, with an oily component as defined above in an amount of 10–90% by weight, preferably 15–75% by weight and especially 25–55% by weight, of the whole mixture, a surfactant mixture consisting of one or more non-ionic surfactants which are selected from the group consisting of ethoxylated, propoxylated and co-ethoxylated/propoxylated surfactants with a Hypophil-Lipophil Balance corresponding to an HLB value of between 5.0 and 11, preferably between 5.5 and 9.9 and especially between 6.0 and 9, in an amount of 0.5–20% by weight of the whole mixture, preferably 1–12% by weight and especially 2–7% by weight, and one or more anionic surfactants as salts as defined above, the amount of the anionic surfactant being 1–100%, calculated in relation to the amount of the nonionic detergent on a weight basis, preferably 2–50% and especially 4–25%, and optionally additives such as antifreeze corrosion inhibitors, additional concrete retarding agents, stabilizers, and hydrophobicity-imparting agents such as polyvalent metal salts of $C_{10-22}$ alkyl carboxylic acids, etc. (HBL=Hydrophil-Lipophil-Balance; HLB values are theoretical, calculated values used in connection with ethoxylated non-ionic detergents. The HLB is directly proportional to the content of polyethylene oxide. HLB values are between 0 and 20; a low HLB indicates an oil-soluble surfactant, and the water-solubility increases with increasing HLB values).

Examples of preferred non-ionic surfactants are ethoxylated $C_{4-15}$ alkyl or di-$C_{4-15}$ alkyl phenols such as ethoxylated octyl or nonyl phenol and ethoxylated dioctyl or dinonyl phenol, ethoxylated $C_{8-22}$ fatty alcohol and polyethylene glycol esters of $C_{10-22}$ fatty acid, all having HLB values as stated above.

The anionic surfactants are provided as a sodium, potassium, lithium, ammonium or a lower amine or alkanolamine salt containing not more than 8 carbon atoms and preferably at the most 6 carbon atoms (e.g. a monoethanolammonium or a mono- or dialkylethanolammonium salt) or a mixed salt of compounds as mentioned below.

Examples of preferred anionic surfactants are salts of mono- and diphosphoric acid esters of ethoxylated $C_{4-15}$ alkyl and di-$C_{2-15}$ alkyl phenols and ethoxylated fatty $C_{8-22}$ alcohols. Salts of $C_{8-22}$ alkylsarcosines, $C_{1-15}$ alkylphenylcarboxylic acids, arylcarboxylic acids, aryl-$C_{1-15}$ alkylcarboxylic acids, $C_{1-15}$ alkylaryl-$C_{1-15}$ alkylcarboxylic acids, phenoxy-$C_{1-15}$ alkylcarboxylic acids, $C_{1-15}$ alkylphenoxy-$C_{1-15}$ alkylcarboxylic acids, $C_{8-30}$ alkylcarboxylic acids and the corresponding dicarboxylic acids and the corresponding unsaturated analogues thereof are also useful. Other useful acid salts are salts of dimerized or trimerized unsaturated fatty acids. Especially useful are salts of $C_{10-30}$ fatty acids such as oleic acid, lauric acid, myristic acid, palmitic acid and stearic acid. Salts of saturated acids are especially preferred as they give the most homogeneous concrete surface and of these, salts of stearic acid give very stable emulsions. Hence, especially preferred anionic surfactants are salts of stearic acid such as sodium and ammonium stearate. Salts of the acids mentioned above may be formed by neutralizing the acids in the emulsions.

It is advantageous that the anionic surfactant is provided as an ammonium or a volatile amine salt as, simultaneous with the evaporation of water, release of ammonia or volatile amine will take place so that the emulsion will be convered into a water-in-oil emulsion more quickly. However, it is no prerequisite that conversion of the salt into acid takes place; thus, compositions may be formed in which the anionic surfactant is present as a sodium salt and in which the mould release agent adheres so strongly to the mould that it is not torn off during the moulding process. It is not a prerequisite that the emulsion has been converted into a water-in-oil emulsion before the filling up with concrete. Concrete is highly alkaline and contains a saturated solution of calcium hydroxide. When this solution comes into contact with the anionic surfactant, the latter will be converted into a calcium salt which is more hydrophobic so that the mould release agent is attached more strongly to the mould.

It is an important feature of the present invention that the surfactant mixture comprises a non-ionic surfactant in a large amount, i.e. 0.5–20% by weight of the total emulsion, e.g. about 5% by weight, in combination with an anionic surfactant in a minor amount, i.e. 0.05–6% by weight of the total emulsion, e.g. about 0.5–1%, such as 0.7%, by weight. The non-ionic surfactant has a stabilizing effect on the emulsion and in combination with the small anionic amount.

It is well-known that an adhering oily film can be prepared from an ammonium salt of a fatty acid, the film being formed when the ammonia part of the salt is liberated and the salt is converted into a free fatty acid. Hence, it was to be expected that anionic surfactants in the form of ammonium and amine salts as defined above should be used in large amounts. The use of large amounts of ammonium salts and the resulting liberation ammonia to the environment would be disadvantageous. It is an important aspect of the invention that the use of anionic surfactants in the form of salts as defined above in combination with large amounts of non-ionic surfactants lead to stable emulsions which shortly after their application to surfaces are converted into adhering oily films or water-in-oil emulsions.

The pH of the emulsion is very important for the emulsion stability, the corrosion stability and the skin tolerance. A pH of 7.4–10.5, preferably 7.8–10 and especially 8.2–9.5 is preferred.

The quality of the water used is also very important for both the emulsion stability and its tendency to cause rust when sprayed onto metal moulds. The use of deionized water cause the fewest corrosion problems, but the tendency to corrode especially depends on the surfactants used. In order to obtain a satisfactory long-term stability of the emulsion formed, it is advantageous to use water of a certain hardness. Thus, the best emulsion stability is obtained when using water with a hardness of 2°–75° d water, preferably 3°–50° d and especially 5°–40°°d (the °d of the water denotes the total amount of Ca+Mg, expressed as the equivalent amount of CaO, 1° d corresponds to 10 mg of CaO).

The emulsion may be prepared by the manufacturer or it may be prepared by the user immediately prior to use by diluting an oily concentrate to the desired concentration, e.g. by diluting with two parts of water.

In case the product is prepared as a product ready for use, it is important that the emulsion has long-term stability and that the resistance to cold is good.

One aspect of the invention relates to a method for improving the release of a moulded concrete body from the mould by applying an effective amount of an oil-in-water emulsion prepared by addition of water to an emulsion concentrate comprising the constituents of the emulsion defined above, but without the content of water. Special emulsions are emulsion which after application on a surface are converted into an adhering oily film or water-in-oil emulsion which will not be easily washed off when rinsing the surface with water.

An oil-in-water emulsion as defined above to be used for improving the release of a moulded concrete body from the mould, is prepared by a method in which one or more non-ionic surfactants is/are dissolved in the oily phase, and the oily phase is added to the aqueous phase in which one or more anionic and optionally one or more cationic surfactants are dissolved or dispersed, the aqueous phase being, if necessary, pH adjusted, and the addition of the oily phase to the aqueous phase being carried out with vigorous stirring.

To obtain a stable emulsion, the mixture of the oily and the aqueous phases with their contents of auxilliary agents may be subjected to an emulsification process in an apparatus conventionally used as an emulsifier, i.e. the mixture may be subjected to an intensive mechanical processing in which it passes through a slit in which it is influenced by high shear forces. Such a slit opening should be at most 10 mm, preferably at most 3 mm, more preferably at most 1 mm, and especially at most 0.2 mm. Examples of apparatuses which may be used are homogenizers, pin disc mills, high-speed mixers of the Silverson type in which the movable part is placed in a stationary cylinder, and high-pressure homogenizers.

To secure the resistance to cold, glycols, and/or lower polyglycols and/or glycol ethers such as glycerol, propylene glycol, ethylene glycol, butylglycol, propylene glycol methylether, cellosolve and diethylene glycol may be added to the mixture. Because of their good skin acceptance, glycerol and propylene glycol are especially preferred. Moreover, the two substances in a total amount of 1-20%, especially in amounts of 5-10%, calculated on a weight basis of the finished emulsion, have a positive effect on the emulsion stability.

Heavy demands are made to the exact adjustment of the described emulsion systems. If the release oil emulsion is to be sold as a finished emulsion, which is preferable, both the emulsion stability during a period of about 3-6 months and the tendency of the emulsion to be converted into a water-in-oil emulsion after spraying onto the mould should be optimized. Heavy selection demands are made to both the single components and to the adjustment of the amounts used.

The finished long-term durable oil-in-water release oil emulsion which after drying forms an oily film or water-in-oil emulsion which cannot easily be washed off with water may thus be prepared by mixing water of a suitable hardness in an amount of 10-90% by weight of the total composition, preferably 20-80% by weight and especially 30-65% by weight, one or more of the oily components described above in an amount of 10-90% by weight, preferably 15-75% by weight, especially 25-55% by weight and additionally 10-40% by weight, a surfactant mixture of one or more ethoxylated non-ionic surfactants with a HLB value between 5.0 and 10.5, preferably between 5.5 and 9.9 and especially between 6.0 and 9, in an amount of 0.5-20% by weight, preferably 1-12% by weight and especially 2-7% by weight, and one or more anionic surfactants which may be provided as a sodium, potassium, lithium, ammonium or a lower amine or alkanolamine salt containing not more than 8 carbon atoms and preferably at the most 6 carbon atoms or a mixed salt thereof, the amount of the anionic detergent being 0.05-4% by weight of the total emulsion, preferably 0.1-4%, more preferably 0.15-2% and especially 0.2-1%. As a further stabilizer and additive for the resistance to cold, the release oil emulsion may contain 1-20%, preferably 2-15% and especially 5-10% by weight of a glycol and/or a lower polyglycol and/or a glycol ether. The pH of the emulsion should be 7.4-10.5, preferably 7.8-10, and more preferably 8.2-9.5.

In a preferred aspect of the invention, the oily component in the oil-in-water emulsion is an ester of an aliphatic carboxylic acid with a mono- or dihydric alcohol, the total number of carbon atoms in the ester being 8-46, especially 10-38, preferably 12-30, and having a melting point of at most 35° C., preferably 25° C., more preferably 15° C.

Another aspect of the invention relates to a method for improving the release of a moulded concrete body from the mould by applying an effective amount of a concrete release composition to the mould. The composition comprises one or more oily esters of aliphatic carboxylic acids with mono- or dihydric alcohols, the total number of carbon atoms in the esters being 8-46, especially 10-38, preferably 12-30, and having a melting point of at most 35° C., preferably 25° C., more preferably 15° C., in an amount of 26-100% by weight, preferably 70-100% by weight, calculated on the total composition, optionally in admixture with other additives such as mineral oils, vegetable or marine oils, glycols, glycol ethers, alkanols, emulsifiers and/or water.

Both when used in emulsions as defined above and when used in non-emulsified form esters are of the type defined below.

It is advantageous to use esters of aliphatic carboxylic acids as defined below with melting points of at most 35° C., preferably 25° C., and especially 15° C., in concrete release compositions, both in emulsified and in non-emulsified form, as the esters of aliphatic carboxylic acids are much more bio-degradable and less toxic than mineral oils; it is possible to modify the extent of release from the mould to fit the desired rate of retardation of the concrete; the esters are less viscous than the mineral oils normally used, and their viscosity index is more suitable, i.e. many esters have viscosity indexes in the range of 120-150, which is especially advantageous when the esters are used in non-emulsified form.

Therefore, it is normally not necessary to add viscosity-decreasing agents when the esters are used in the non-emulsified form, and an environmental hazard is thus removed.

According to one aspect of the present invention it is preferred to use fatty acid esters in high concentrations as release compositions in non-emulsified form. Therefore, it is important that the esters are only slightly retarding. A high content of a strong retarding agent would cause the concrete surface to become inhomogeneous, stained and uneven. The present invention relates to the use of only slightly reactive esters which may replace mineral oil as the inert hydrophobic material, in conventional release compositions in non-emulsified form.

Tests have shown that monoesters of fatty acids may be selected so that they have only an insignificant retarding action on the concrete surface, thus leaving the surface of the moulded concrete body hard and smooth (a retarded surface of a moulded concrete body can be rough and porous). On the other hand, it is possible by modifying the composition, e.g. by selecting esters derived from a short-chained alcohol, especially methyl esters, to obtain a monoester with the same retarding effect as vegetable oils.

A preferred composition comprises 65-99%, preferably 80-97%, by weight of the esters, the remaining part of the composition being wetting agents, corrosion-inhibitors and retarding agents.

In one aspect of the invention, the alcohol moiety of the ester is derived from a monoalcohol of the formula I or II $$R_1OH \qquad \text{I}$$

$$R_2O—R_3—OH \qquad \text{II}$$

in which $R_1$ and $R_2$ are each a straight or branched, saturated or unsaturated hydrocarbyl group of 1-22 carbon atoms, and $R_3$ is a straight or branched, saturated or unsaturated hydrocarbylene chain of 2-22 carbon atoms, and the total number of carbon atoms in $R_2$ and $R_3$ is at most 24. It is preferred that the hydrocarbyl groups $R_1$ and $R_2$ each have 2-20 carbon atoms, especially 2-12 and more preferably 6-9 carbon atoms, and that $R_3$ is a straight or branched saturated hydrocarbylene chain of 2-9 carbon atoms.

As examples of alcohols of the formulae I and II, there may be mentioned methanol, ethanol, propanol, isopropanol, butanol, isobutanol, amyl alcohol, hexyl alcohol, heptyl alcohol, isoheptyl alcohol, octyl alcohol, isooctyl alcohol, 2-ethyl-hexyl alcohol, nonyl alcohol, cetyl alcohol, isocetyl alcohol, ethoxyethanol, butoxyethanol, and unsaturated analogues thereof. Preferred alcohols are isopropanol, isobutanol, octyl alcohol, isooctyl alcohol, 2-ethyl-hexyl alcohol and nonyl alcohol.

The acid moiety in the esters may be derived from an aliphatic monocarboxylic acid of the formula $R_4COOH$ in which $R_4$ is a straight or branched, saturated or unsaturated hydrocarbyl group of 1-30 carbon atoms, preferably 8-20 carbon atoms, and optionally substituted by one or more hydroxy groups, the acid moiety preferably being derived from a saturated carboxylic acid. Examples of such acids are butanoic acid, hexanoic acid, octanoic acid, decanoic acid, 2-ethyl-hexanoic acid, lauric acid, myristic acid, palmitic acid, stearic acid and hydroxy-substituted stearic acid. Furthermore, mixtures of fatty acids such as $C_{16}$ and $C_{18}$ fatty acids may be used.

A preferred class of esters to be used according to the invention consists of esters selected from the group consisting of 2-ethyl-hexyl laurate, 2-ethyl-hexyl myristate, 2-ethyl-hexyl palmitate, 2-ethyl-hexyl stearate, isobutyl stearate, isopropyl myristate, isooctyl esters of $C_{16}$ and $C_{18}$ fatty acids, and mixtures thereof.

Another preferred class of acid moieties is derived from unsaturated acids such as oleic acid, or ricinoleic acid, e.g. 2-ethyl-hexyl oleate and isobutyl oleate.

Especially suitable esters are $C_{2-20}$ monoalcohol esters of oleic acid, $C_{2-12}$ monoalcohol esters of lauric and myristic acids and $C_{6-9}$ monoalcohol esters of palmitic and stearic acids.

In another aspect of the invention, the acid moiety of the ester is derived from an acid of the general formula $HOOC—(A)_m—COOH$ in which A is a straight or branched, saturated or unsaturated hydrocarbylene chain of 2-16 carbon atoms which is optionally substituted by one or more hydroxy groups, and m is 0 or 1.

Examples of dicarboxylic acids are oxalic acid, succinic acid, 2-hydroxy succinic acid, 2,3-dimethyl succinic acid, glutaric acid, adipic acid, pimelic acid, hexanedicarboxylic acid, azelaic acid, and sebacic acid, the acids being esterified on one or both of the acid groups.

In another preferred aspect of the invention, the ester component in the concrete release composition both in emulsified and in non-emulsified form is a mixture of at least two esters selected from the group consisting of diisobutyl succinate, diisopropyl adipate, di(ethyl-hexyl) succinate, di(ethyl-hexyl) adipate, and mono(ethyl-hexyl) adipate, optionally in admixture with 2-ethyl-hexyl stearate or 2-ethyl-hexyl palmitate. These esters are preferred because of their viscosity which makes them especially suitable as mould release agents in non-emulsified form. Furthermore, they are inexpensive.

A suitable ester may also be derived from an acid of the formula $HOOC—A'—COOH$ in which A' is a unsaturated hydrocarbylene chain of 2-6 carbon atoms.

Further examples of esters in the mould release compositions to be used in the methods according to the invention are esters wherein the alcohol moiety is derived from a dialcohol of the formula IIa, IIb, or IIc

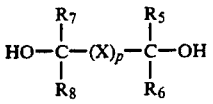

IIa

-continued

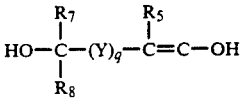

IIb wherein $R_5$, $R_6$, $R_7$ and $R_8$ may be the same or different and each designates hydrogen, straight or branched alkyl or straight or branched unsaturated hydrocarbyl chain, p is 0 or 1, q is 0 or 1, X is a straight or branched saturated or unsaturated hydrocarbylene chain of 1-15 carbon atoms, and Y is a straight or branched saturated or unsaturated hydrocarbylene chain of 1-15 carbon atoms, the total number of carbon atoms in the dialcohol molecules being at most 18, preferably at most 12.

A preferred class of esters of the above-mentioned class are esters wherein the alcohol moiety is derived from alcohols selected from the group consisting of ethylene glycol, propylene glycol, hexylene glycol, dimethyl propanediol, and 2,2,4-trimethylene pentane(-1,3)-diol.

The acid moiety of esters in which the alcohol moiety is derived from a dialcohol of the formula IIa, IIb or IIc is derived from an acid of the formula $R_9COOH$ wherein $R_9$ is a straight or branched, saturated or unsaturated hydrocarbyl group of 1-22 carbon atoms which is optionally substituted by one or more hydroxy groups, and the acid is preferably selected from the group consisting of formic acid, acetic acid, propionic acid, isopropionic acid, butyric acid, isobutyric acid, lactic acid, pentanoic acid, hexanoic acid, isoheptanoic acid, octanoic acid, isooctanoic acid, 2-ethylhexanoic acid, nonanoic acid and decanoic acid, and mixtures of $C_{16}$ and $C_{18}$ fatty acids.

Hence, preferred esters to be used in the method according to the invention are selected from the group consisting of ethyleneglycol diisobutyrate, propyleneglycol diisobutyrate, hexyleneglycol monoisobutyrate, hexyleneglycol diisobutyrate, dimethylpropanediol monoisobutyrate, dimethylpropanediol diisobutyrate, 2,2,4-trimethylpentane-(1,3)-diol monoisobutyrate and 2,2,4-trimethylpentane-(1,3)-diol diisobutyrate.

Examples of esters which are believed to be especially useful in compositions to be applied on the mould in non-emulsified form in the method according to the invention are: hexyl acetate, 2-ethylhexyl acetate, octyl acetate, isooctyl acetate, cetyl acetate, dodecyl acetate, tridecyl acetate; butyl butyrate, isobutyl butyrate, amyl isobutyrate, hexyl butyrate, heptyl butyrate, isoheptyl butyrate, octyl butyrate, isooctyl butyrate, 2-ethylhexyl butyrate, nonyl butyrate, isononyl butyrate, cetyl butyrate, isocetyl butyrate;

ethyl hexanoate, propyl hexanoate, isopropyl hexanoate, butyl hexanoate, isobutyl hexanoate, amyl hexanoate, hexyl hexanoate, heptyl hexanoate, isoheptyl hexanoate, octyl hexanoate, 2-ethylhexyl hexanoate, nonyl hexanoate, isonynyl hexanoate, cetyl hexanoate, isocetyl hexanoate;

methyl octanoate, ethyl octanoate, propyl octanoate, isopropyl octanoate, butyl octanoate, isobutyl octanoate, amyl octanoate, hexyl octanoate, heptyl octanoate, isoheptyl octanoate, octyl octanoate, isooctyl octanoate, 2-ethylhexyl octanoate, nonyl octanoate, isononyl octanoate, cetyl octanoate, isocetyl octanoate;

methyl 2-ethylhexanoate, ethyl 2-ethylhexanoate, propyl 2-ethylhexanoate, isopropyl 2-ethylhexanoate, butyl 2-ethylhexanoate, isobutyl 2-ethylhexanoate, isoamyl 2-ethylhexanoate, hexyl 2-ethylhexanoate, heptyl 2-ethylhexanoate, isoheptyl 2-ethylhexanoate, octyl 2-ethylhexanoate, isooctyl 2-ethylhexanoate, 2-ethylhexyl 2-ethylhexanoate, nonyl 2-ethylhexanoate, isononyl 2-ethylhexanoate, cetyl 2-ethylhexanoate, isocetyl 2-ethylhexanoate;

methyl decanoate, ethyl decanoate, propyl decanoate, isopropyl decanoate, butyl decanoate, isobutyl decanoate, isoamyl decanoate, hexyl decanoate, heptyl decanoate, isoheptyl decanoate, octyl decanoate, isooctyl decanoate, 2-ethylhexyl decanoate, nonyl decanoate, isononyl decanoate, cetyl decanoate, isocetyl decanoate;

methyl laurate, ethyl laurate, propyl laurate, isopropyl laurate, butyl laurate, isobutyl laurate, isoamyl laurate, hexyl laurate, heptyl laurate, isoheptyl laurate, octyl laurate, isooctyl laurate, 2-ethylhexyl laurate, nonyl laurate, isononyl laurate, cetyl laurate, isocetyl laurate;

ethyl oleate, propyl oleate, isopropyl oleate, butyl oleate, isobutyl oleate, isoamyl oleate, hexyl oleate, heptyl oleate, isoheptyl oleate, octyl oleate, isooctyl oleate, 2-ethylhexyl oleate, nonyl oleate, isononyl oleate, cetyl oleate, isocetyl oleate;

diethyl succinate, dipropyl succinate, diisopropyl succinate, dibutyl succinate, diisobutyl succinate, diisoamyl succinate, dihexyl succinate, diheptyl succinate, diisoheptyl succinate, dioctyl succinate, diisooctyl succinate, di-2-ethylhexyl succinate, dinonyl succinate, diisononyl succinate, dicetyl succinate, diisocetyl succinate;

dimethyl adipate, diethyl adipate, dipropyl adipate, diisopropyl adipate, dibutyl adipate, diisobutyl adipate, diisoamyl adipate, dihexyl adipate, diheptyl adipate, diisoheptyl adipate, dioctyl adipate, diisooctyl adipate, di-2-ethylhexyl adipate, dinonyl adipate, diisononyl adipate, dicetyl adipate, diisocetyl adipate;

isopropyl myristate, isobutyl myristate, butyl myristate, amyl myristate, hexyl myristate, heptyl myristate, isoheptyl myristate, octyl myristate, 2-ethylhexyl myristate, nonyl myristate, isononyl myristate, cetyl myristate, isocetyl myristate;

isopropyl palmitate, isobutyl palmitate, butyl palmitate, amyl palmitate, hexyl palmitate, heptyl palmitate, isoheptyl palmitate, octyl palmitate, 2-ethylhexyl palmitate, nonyl palmitate, isononyl palmitate, cetyl palmitate, isocetyl palmitate;

isopropyl stearate, isobutyl stearate, butyl stearate, amyl stearate, hexyl stearate, heptyl stearate, isoheptyl stearate, octyl stearate, 2-ethylhexyl stearate, nonyl stearate, isononyl stearate, cetyl stearate, isocetyl stearate.

The rate of retardation may be varied by changing the ester composition. In general, if short-chained alcohols are used in the esters, the esters will act more retarding; tests have shown that methyl oleate has a retarding effect in the same range as vegetable oils; in some application areas, such as in the production of concrete articles where the character of the surface is of less importance, a certain retarding effect is desired, as a good release activity is ensured.

If the acid moiety of the ester has a high level of double and triple bonds such as in tall oil (containing both linolic and linoleic acids), the retarding effect will be large even if the alcohol moiety is derived from a long-chained alcohol. Hence, esters of tall oil can be used when the retarding effect is to be increased. Calcium salts of linolic and linoleic acids are sticky. Vegetable oils which always contain linolic and linoleic acids yield esters which may give the concrete surface a blotched appearance when used alone in release compositions.

Owing to their hydrophobic properties the synthetic esters are in general able to ensure an advantageous release effect without having a decisive retarding effect on the surface of the concrete body, thus imparting an attractive surface to the concrete body. These properties could also be achieved by using mineral oil products, but not, or only with difficulties, by using vegetable oils. However, mineral oil products are normally not biodegradable as are the synthetic esters used according to the invention. Normally the mould release agent is rinsed off the mould after use by means of water which is conducted to the environment or the moulds are brushed off and the dust conducted to the environment. Therefore, the use of biodegradable synthetic esters results in less or no poisoning of the environment.

The compositions in non-emulsified form comprising the oily esters in an amount of 26–100%, preferably 70–100%, optionally in admixture with additives, may be used per se in the form of a homogeneous liquid.

A further aspect of the invention relates to a method for improving the release of a moulded body from the mould by applying an effective amount of a concrete release composition to the mould, the composition being in the form of an emulsion of water in an oily component, an emulsion of an oily component in water or a microemulsion in which 26–100% by weight of the oily component is an ester as defined above.

The liquid mould release compositions, both in emulsified and in non-emulsified form, may be applied to the surface of the mould, e.g. by spraying with a normal spraying device such as a hand sprayer, or by means of compressed air, or by means of a brush. The compositions are used in an amount of 10–100, especially 15–70, and preferably 20–50, $g/m^2$ surface of the mould.

Many laboratory tests have shown that the mould release compositions comprising esters in emulsion form described above may give highly satisfactory test results for long periods of time, but that they may then suddenly fail as the release effect decreases and concrete residues which are difficult to wash off are left behind. This has also been observed in practical tests. The reason may be that the esters are not 100% stable and that, during the concrete curing process, they are to a limited degree saponified (decomposed) to free fatty acids which will act in a limited retarding way on the concrete and thus promote the release effect. If the curing takes place slowly, the saponification process (the decomposition of the ester) may be very limited so that it becomes more difficult for the cured concrete to be released from the mould. Most moulding tests have been carried out in a way so that the demoulding occurs after 24 hours. It has been found that the release problems become greater if the curing is complete already after 16–17 hours.

A number of screening tests have shown the following results:

1) glycerol may act slightly adhesive and thus bind the concrete to the mould, which means that the use of glycerol is limited, 2) the ethoxylated non-ionic surfactant may also act slightly adhesive and the tendency is the weakest if the degree of ethoxylation is as small as possible, 3) addition of surfactants with cationic groups containing an amino group or another group comprising a quaternary N-atom and with at least 10 carbon atoms in the hydrophic part of the molecule in combination with the anionic detergents mentioned above will lead to emulsions which to a still higher degree will stick to the concrete mould. The cationic surfactant should be employed in amounts of 5–100%, calculated on a molar basis of the anionic surfactant, preferably 10–80% and especially 20–60%. When the emulsion binds optimally to the mould so that it is distributed in a layer with a homogeneous thickness, it will be more active and thus promote the release effect. Examples of suitable surfactants are mono-, di- and trivalent amines, ethoxylated amines, quarternary ammonium compounds, ampholytes (amphoteric compounds containing at least one amine group and at least one acid group). A suitable ampholyte is coco alkyl β-amino propionic acid. Examples of especially suitable cationic surfactants are imidazoline derivatives such as 1-(2-hydroxyethyl)-2-$C_{8-22}$-alkyl- and -$C_{8-22}$alkenyl-2-imidazoline, e.g. imidazoline O (1-(2-hydroxyethyl)-2-heptadecenyl-2-imidazoline).

4) retarding agents which release carboxylic acids or hydroxycarboxylic acids will also improve the release effect. Monoglycerides of $C_{2-24}$ fatty acids which are fully or partially acylated with a $C_{1-4}$ organic acid are especially suitable. Diacetylated monoglycerides are used in the food industry and are characterized by being low-viscous liquids at normal temperature, also if the fatty acid moiety is saturated. Monoglycerides and diacetylated monoglycerides of $C_{8-24}$ fatty acids may be so selected that they efficiently stabilize the release oil emulsion simultaneous with reducing the content of the ethoxylated and/or propoxylated and/or co-ethoxylated/propoxylated non-ionic surfactant. The glyceride derivatives mentioned above may be so selected that the content of the long-chain carboxylic acids is preferably saturated. This ensures that the concrete retardation occurs without the concrete surface becoming stained.

Mono- or di-$C_{1-4}$ acylated monoglycerides of $C_{2-24}$ fatty acids which optionally bear a hydroxy group, yield a retarding effect on concrete release agents, which means that they can be used as concrete release agents in non-emulsified form together with mineral oil(s) and/or esters of the type defined above. The monoglycerides are preferably mono- or diacetyated or mono- or diformylated. The fatty acid may be saturated or unsaturated.

Long-term stable oil-in-water release oil emulsions which are stable at normal storage for at least 3–6 months with good release properties and in which the single components can be adjusted to the effect that the emulsion in a dosage on the concrete mould of 10–100 g/m$^2$, preferably 15–70 g/m$^2$ and especially 20–50 g/m$^2$ after a drying period of 2–20 minutes at ambient temperature above the freezing point, e.g. at about 20° C., and at a relative humidity of about 40–70% is converted into an attached film which cannot immediately be washed off with water or at filling-up be rubbed off by the concrete mixture. Such an emulsion may be prepared by mixing water of a suitable hardness in an amount of 10–90% by weight of the total composition, preferably 20–80% and especially 30–65%, and an oily component as defined above in an amount of 10–90% by weight, preferably 15–75% especially 25–55%, and additionally 10–40% by weight to which has been added a non-ionic surfactant component comprising a mono- or di-$C_{1-4}$-acylated, preferably mono-or diacetylated, monoglyceride of a saturated or unsaturated $C_{2-24}$ fatty acid, preferably a $C_{8-24}$ fatty acid which may optionally bear a hydroxy group and optionally one or more ethoxylated, propoxylated and/or co-ethoxylated/propoxylated non-ionic surfactants with a HLB value of between 5.0 and 10.5, preferably between 5.5 and 9.9 and especially between 6.0 and 9, and/or one or more monoglycerides of saturated or unsaturated $C_{8-24}$ fatty acids which may optionally bear a hydroxy group. The non-ionic surfactant component may also comprise at least one member of the group consisting of ethoxylated, propoxylated and/or co-ethoxylated/propoxylated surfactants with an HLB value of 5–10.5, preferably 5.5–9.9, and especially 6–9, monoglycerides of saturated and unsaturated $C_{8-24}$ fatty acids, optionally bearing a hydroxy group, and mono- or di-($C_{1-4}$)-acylated monoglycerides of $C_{2-24}$ fatty acids, optionally bearing a hydroxy group. The non-ionic surfactant component is used in an amount of 0.5–20% by weight of the total emulsion, preferably 1–12% and especially 2–7%. Furthermore, the emulsion should contain a composition of ionic (anionic/cationic mixture) surfactants comprising at least one anionic surfactant which may be provided as a sodium, potassium, lithium, ammonium or a lower amine or alkanolamine salt containing at most 8 carbon atoms, preferably at most 6 carbon atoms, in the alkyl and alkanol moiety, or a mixed salt thereof. The amount of the anionic part of the ionic surfactant composition should preferably be 0.05–6% by weight of the total emulsion, preferably 0.1–4%, more preferably 0.15–2.0% and especially 0.2–1.0%. The cationic part of the ionic surfactant comprises one or more surfactants containing at least 10 carbon atoms in the hydrophobic part of the molecule and at least one amino group or another cationic nitrogen atom (such as in a quaternary ammonium compound). Examples of suitable cationic surfactants are mono-, di- and trivalent amines, ethoxylated amines, quarternary ammonium compounds, ampholytes (amphoteric compounds containing at least one amine group and at least one acid group). A suitable ampholyte is coco alkyl β-amino propionic acid. Examples of especially suitable cationic surfactants are imidazoline derivatives such as 1-(2-hydroxyethyl)-2-$C_{8-22}$-alkyl- and -$C_{8-22}$-alkenyl-2-imidazoline, e.g. imidazoline O (1-(2-hyroxyethyl)-2-heptadecenyl-2-imidazoline). The molar amount of the amine-containing surfactant in relation to the anionic surfactant should be 5–100%, preferably 10–80% and especially 20–60%. Moreover, the amount of salt should be adjusted so that the pH of the emulsion is in the range of 7.4–10.5, preferably 7.8–10 and especially 8.2–9.5. As a further stabilizer and additive for the resistance to cold, the mould release composition in emulsion form may contain 1–20%, preferably 2–15% and especially 5–10% of one or more glycols and/or glycol ethers and/or polyglycols in which the number of ether groups does not exceed 5. Examples of suitable glycol components are glycerol, propylene glycol, ethylene glycol, butylglycol, propylene glycol methyl ether, cellosolve and diethylene glycol.

It is often possible to improve the release properties and the emulsion stability of the release oil emulsions used according to the present invention by incorporating, as a hydrophobicity-imparting agent, a divalent or trivalent metal salt of a $C_{10-30}$ fatty acid, preferably of a saturated fatty acid, and in an amount of 0.05–5% by weight, calculated on the finished emulsion, preferably 0.1–3% and especially 0.2–1%. Examples of especially suitable salts are calcium, magnesium, zinc and aluminum palmitate and stearate.

The preparation of finished long-term stable release oil emulsions is preferably carried out by dissolving or dispersing the anionic and cationic surfactant in the aqueous phase and adjust the pH of the water to the desired value in the finished emulsion by adding the base corresponding to the finished salt. The non-ionic surfactants are normally dissolved in the oily phase. Optionally, sparingly soluble divalent or trivalent metal salts of $C_{10-30}$ fatty acids may be incorporated by first dispersing them in the oily phase before the preparation of the emulsion. It is possible to mix and disperse the glycol components in both the oily phase and the aqueous phase before the mixing thereof. The final emulsion is prepared by adding the oily phase into the water phase with stirring. If necessary, the pH may then be adjusted to a higher value by the addition of a base. In order to prepare a long-term stable emulsion, a final intensive processing as stated above is necessary. The preparation is performed at a temperature between −5° and +80° C., preferably a temperature of 5°-55° C. and especially 10°-35° C.

The emulsions described above may be prepared as long-term stable emulsions with a low viscosity. As determined by an Emila viscosimeter, the viscosity at 40° C. should be below 40 cP, preferably below 25 cP and especially below 15 cP. At 20° C., the viscosity should be below 60 cP, preferably below 40 cP and especially below 20 cP.

If the final emulsification process is carried out at high temperature, i.e. above 40° C., but depending on the composition, and under vigorous conditions, and if the mixture to be emulsified comprises a surfactant with a relatively low HBL value, an emulsion with a higher viscosity, i.e. above 200 cP, may be obtained. This phenomenon may be due to a formation of an emulsion system consisting of a mixture of both water-in-oil and oil-in-water emulsions, which means that a part of the initially formed oil-in-water emulsion has been converted into a water-in-oil emulsion. It is contemplated that the water-in-oil emulsion is emulsified in the oil-in-water emulsion. It is contemplated that this phenomenon corresponds to the conversion which takes place after the spreading on the mould surface and the evaporation of water as mentioned above.

As mentioned above, it is preferred that the release composition comprises an additive which imparts corrosion protection properties to the composition so as to prevent rust on steel moulds. In a general aspect, the emulsions described above will also be useful as corrosion inhibitors. The corrosion-inhibiting properties may be achieved or improved by increasing the amount of anionic surfactant selected from the group consisting of $C_{8-22}$ alkyl or $C_{8-22}$ alkenyl sarcosines, $C_{6-20}$ alkyl or $C_{6-20}$ alkenyl succinic acids, $C_{6-20}$ alkyl or $C_{6-20}$ alkenylphenoxyacetic acid, $C_{8-22}$ alkylsulfamido carboxylic acid, $C_{1-10}$ alkylarylsulfamido carboxylic acid and arylsulfamido carboxylic acid, the total amount of anionic surfactant in the composition being 0.5-12% by weight, preferably 1-9.5%, more preferably 2-7%, and especially 3-5% by weight, based on the total composition, and cationic surfactant, the amount of the cationic surfactant being 5-150%, calculated on the basis of the molar amount of the anionic surfactant present in the emulsion. (It will be appreciated that the anionic surfactants may further comprise a carbylene chain in the molecule, which does not appear from their names, i.e. an "aryl sulfamido carboxylic acid" is in fact an "aryl sulfamido carbylene carboxylic acid"). The cationic surfactants of the same type as mentioned above are to be used in an amount of 5-150%, preferably 10-100% and especially 20-50%, on a molar basis, calculated on the molar amount of the anionic surfactant.

In another aspect, the present invention relates to a method for protecting metallic surfaces against corrosion by applying an oil-in-water emulsion containing water in an amount of 10-90% by weight of the total emulsion, an oily component in an amount of 10-90% by weight of the total emulsion, one or more non-ionic surfactants, in an amount of 0.5-20% by weight of the total emulsion, an anionic surfactant provided as a sodium, potassium, lithium, ammonium or lower alkylamine, lower alkyl-alkanolamine or lower alkanolamine salt of at the most 8 carbon atoms or a mixed salt, in an amount of 1-95% by weight, based on the non-ionic surfactant, and a cationic surfactant comprising at least 10 carbon atoms in the hydrophobic part of the molecule and at least one amino group or another cationic nitrogen atom in the hydrophilic part of the molecule, in a molar amount of 5-150%, preferably 10-100%, more preferably 20-50%, based on the molar amount of anionic surfactant. For this use, the composition of the emulsion with respect to the oily component, the non-ionic surfactant, the anionic surfactant, and the cationic surfactant will normally be selected according to the same criteria as discussed above in connection with the emulsions used for mould release purposes; in other words, the same individual species of these constituents will normally be selected and combined with each other in the same manner as described above and using the same relative amounts of constituents and the same concentrations, including the same preferred species, the same preferred relative amounts and the same preferred concentrations, as describe above. The amounts applied on the objects to be protected in this aspect of the invention will correspond to the amounts and preferred amounts described above in connection with the mould release aspect of the invention. This method of the invention for protecting metallic surfaces against corrosion is particularly useful when the metallic surfaces are surfaces of steel, in particular cast iron, especially in connection with temporary protection of such articles which are stored for a certain period under indoor conditions, e.g. articles which are intermediate products or articles in the preparation of final machines or machine parts or final structures, such as steel panels, cast iron machine parts of any kind, cast iron final articles which are protected by means of the emulsion before they receive a permanent protection, steel panels, car frames, V-belt pulleys, etc. In this corrosion-protecting aspect of the invention, the emulsions may especially be used in the same manner and for for the same purposes as the hydrocarbon solvents nowadays used for such temporary protection. Compared to the hydrocarbon solvents, the emulsions used according to the invention are advantageous in that they are considered safe and without health hazards.

TEST METHODS

Determination of Release Action and Examination of the Appearance of the Concrete Surface and Concrete Residues in the Mould The retarding effect and the other characteristics as release agents of the compositions to be used in the method according to the invention were determined by an examination of concrete flags moulded in standard moulds under standard conditions.

The mould material was stainless steel, and in the case of oil-in-water emulsions, plywood with a coating meant for moulding of concrete, and the mould size was 350×200×80 mm. Common plastic concrete with a slump of 90–110 mm, a density of about 2350 kg/m$^3$ and a content of air of about 2% was used. The amount of applied release agent was about 35 g/m$^2$, applied by spraying. The temperature of the release agent was 20° C. The deposition of the concrete was performed 5–15 minutes after the spraying; the concrete was vibrated for about 20 seconds; the curing temperature was 20° C. and the curing time 24 hours.

After curing for 24 hours at 20° C., the bodies were demoulded. The release ability was tested in the following way: After removal of the outer frame of the mould, the flag was left on the mould basis. One of the ends of the mould basis was tilted until the flag started to slide down; then the tilting angle was measured. If the flag had not left the basis when it had been tilted to 90°, a tensile test was performed and the force necessary to remove the flag was determined. The bodies were examined for residues of concrete left on the mould and release agent left on the concrete surface, and the ease of cleaning the mould was estimated. The retardation (absence of hardening) of the surface of the concrete body was tested by means of a springloaded knife, the paintability was tested by estimating the water-repellance. The amount of discolorations and pores in the surface was determined.

The test results were expressed in points in the range of 1–5, and the tilting angle was measured (°). (It appears that a high number of points does not necessarily reflect better properties). The scale used can be explained by the following table:

| Scale | 1 | 3 | 5 |
|---|---|---|---|
| Residual concrete in the mould | Much | Normal | Little |
| Release agent left in the mould | Little | Normal | Much |
| Mould cleaning properties | Difficult | Normal | Easy |
| Discolorations on concrete | Many | Normal | Few |
| Pores in concrete | Many | Normal | Few |
| Retardation on concrete | Much | Normal | Little |
| Suitable for painting | Water-repellent | Normal | Water-absorbent |

The test results based on the scale above are shown in Table I which also contains the composition of the release agents used.

The retarding effect of a release agent on concrete can be determined by mixing an amount of release agent in the concrete before moulding it into a test body. When the test body has been cured, a test for bending strength (in MN/m) can be performed. The amount of release agent is stated as % by weight, based on the amount of cement in the mortar mixture 1:3. The reference test is mortar without release agent added, and mortar with a normal commercially available release agent based on mineral oil is used as comparison. The test results are shown in Table II together with results of tests showing the compressive strength (determinations performed in duplicate; mean value stated in the table) and the indices for bending strength and compressive strength, respectively (percentage of the value obtained with concrete without release agent added). The retarding effect of a release agent is reflected in a decreased strength in this test. The measurements were performed after 1, 3 and 7 days at 20° C. or after 2, 3, 5, 7, 14 and 28 days.

Biodegradability

Biodegradability is expressed as TOD (Theoretical Oxygen Demand) assessed by means of manometric respirometry according to the method described by the Standing Committee of Analysts, Water Research Centre, Streven, GB. The test results are shown in Tables III, IV and V.

Viscosity

Viscosity measurements were carried out at 20° C. by means of an Emila viscosimeter whereby the viscosity measurements were stated directly in cP. Viscosity measurements of emulsions on a Emila viscosimeter are not very accurate because the viscosimeter itself excercises a certain degree of shear stress which influences the viscosity of the emulsion during the measurement, but the accuracy and reliability of the measurements are sufficient to be relevant in distinguishing between different formulations.

The viscosity of water-in-oil emulsions depends on the intensity of the emulsification process. Differences in measurements on emulsions are partly due to emulsification differences, but addition of viscosity-decreasing agents is so significant that the differences in emulsification are negligible.

EXAMPLES

Preparation of release agents

Example 1

A mould release agent of the following composition was prepared:

| | |
|---|---|
| 2-Ethyl-hexyl ester*) | 94 kg |
| Refined wool grease | 4 kg |
| Ethoxylated nonylphenol (HLB about 9) | 2 kg |
| Total | 100 kg |

*)Prepared from an acid mixture consisting of:
Stearic acid: 32%
Palmitic acid: 51%
Myristic acid: 14%
Lauric acid: 3%
and 2-ethyl-hexyl alcohol in stoichiometric amounts.

The ingredients were mixed at ambient temperature by means of a standard mixing apparatus. The resulting mixture was stable for several months.

Example 2

A mould release agent of the following composition was prepared:

| | |
|---|---|
| Oily phase: | |
| 2-Ethyl-hexyl ester*) | 23 kg |
| Rape oil | 4.6 kg |
| Mineral oil (Gulfpar 19) | 27.6 kg |
| Non-ionic emulsifier (HLB = 3) | 4.2 kg |
| Triethanolamine-oleic acid ester | 0.6 kg |
| Aqueous phase: | |
| Tap water | 39.2 kg |
| $MgSO_4$ | 0.4 kg |
| Acrylate solution (40%) | 0.4 kg |

-continued

| | |
|---|---|
| Total | 100.0 kg |

*)The same ester composition as used according to Example 1.

The aqueous phase was dispersed in the oily phase by means of a high-speed mixer of the Silverson type with a peripheral speed of about 1500 meter/minute at 30° C. for 10 minutes.

The resulting emulsion was stable.

Example 3

A mould release agent of the following composition was prepared:

| | | | 3a | 3b | 3c |
|---|---|---|---|---|---|
| Aqueous phase: | | | | | |
| Tap water | | | 4900 g | 4900 g | 4900 g |
| Stearic acid | | | 70 g | 70 g | 70 g |
| Imidazoline O[1] | | | 30 g | 30 g | 30 g |
| Ammonia ad pH 9 | | | + | + | + |
| Oily phase: | | | | | |
| Radia 7131[2] | | | 3950 g | 1850 g | 3800 g |
| Risella oil 15[3] | | | – | 2000 g | – |
| Propylene glycol | | | 500 g | 500 g | 500 g |
| Berol 26[4] | | | 150 g | 150 g | 150 g |
| Berol 259[5] | | | 150 g | 150 g | 150 g |
| Grindtek Amos 90[6] | | | 250 g | 250 g | 250 g |
| Grindtek MOP 90[7] | | | | 100 g | 100 g |
| Ceasit I[8] | | | | | 50 g |
| | | Risella oil | | | |
| Viscosity at 20° C. | Emila | 25 | 14.5 | 15.5 | 17 |
| Viscosity at 40° C. | Emila | 12 | 9.5 | 11 | 13 |
| Viscosity at 20° C. | | 2.08 | 1.52 | 1.41 | 1.31 |
| Viscosity at 40° C. | | | | | |

[1]Imidazoline O: 1-(2-hydroxyethyl)-2-heptadecenyl-2-imidazoline (Protex)
[2]Radia 7131: Technical 2-ethylhexyl stearate (Oleofina)
[3]Risella oil 15: Paraffinic mineral oil (Shell) (viscosity at 40° C.: 15 cSt) (comprises about 1% of aromates)
[4]Berol 26: Poly (4) ethoxylated nonyl phenol (Berol) (HLB: 8.9)
[5]Berol 259: Poly (2) ethoxylated nonyl phenol (Berol) HLB: 5.7)
[6]Grindtek Amos 90: Acetylated monoglyceride prepared from lard (Grindsted Products)
[7]Grindtek MOP 90: Fatty acid monglyceride prepared from lard (Grindsted Products)
[8]Ceasit I: Micronized Ca-stearate (Chemische Werke München).

The oily phase was mixed into the aqueous phase with stirring. The mixture was homogenized in a high-pressure emulsifier at 200 bar. The inlet temperature was 26° C., and the outlet temperature was 35° C. The high-pressure emulsifier was APV Gaulin, Type Lab 60/500/2 with a capacity of 60 l/h and a pressure $P_{max}$ of 500 bar.

Risella oil (Shell) is a low-viscous paraffinic mineral oil with a viscosity of 15 cSt at 40° C. (according to specifications from Shell). Risella has been used as a reference in the above measurements. The comparison shows especially that the aqueous emulsions are much less temperature-dependent than is the mineral oil. This is advantageous when the emulsions are to be used at low temperatures.

All release agents used in the tests described below were prepared as described in Example 1, Example 2, or Example 3.

TEST RESULTS

Releasing Characteristics

Mould release compositions in non-emulsified form and with the composition stated in Table I below were applied to the standard steel moulds and mould release compositions in emulsion form of compositions as stated in Tables IIa, IIb and IIc, respectively, were applied to standard steel and plywood moulds by means of a normal spraying device for liquids, in an amount of 35 g/m$^2$. Thereafter, common plastic concrete was poured into the moulds and left to cure and thereafter tested as described above under TEST METHODS. The results appear from Tables I, IIa, IIb, and IIc, wherein S=stainless steel, and P=plywood.

TABLE I

| Test No. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Untreated | * | | | | | | | | | | | | | | | |
| Soy oil | | 100 | | | | | | | | | | | | | | |
| Linseed oil | | | 100 | | | | | | | | | | | | | |
| Isobutyl stearate | | | | 100 | | | | | | | | | | | | |
| Mineral oil | | | | | 80 | | | | 46 | | | 48 | | | | 46 |
| Aliphatic kerosene | | | | | 20 | | | | | | | | | | | |
| 2-ethyl-hexyl oleate | | | | | | 100 | | | | | | | | | | |
| 2-ethyl-hexyl palmitate | | | | | | | 92 | 46 | 46 | 96 | 48 | 48 | 92 | 92 | 46 | 46 |
| Low viscous liquid refined paraffin oil | | | | | | | | 46 | | | 48 | | | | 46 | |
| Wool grease | | | | | | | 8 | 8 | 8 | | | | | | | |
| Ethoxylated nonyl-phenol (HLB about 9) | | | | | | | | | | 4 | 4 | 4 | | | | |
| Tall oil acid | | | | | | | | | | | | | 8 | | | |
| Oleic acid | | | | | | | | | | | | | | 8 | 8 | 8 |
| Tilting angle, ° | >90 | 60 | 40 | 40 | >90 | 65 | 20 | 20 | 20 | 35 | 35 | 20 | 20 | 20 | 25 | 30 |
| Residual concrete in the | 1 | 2 | 3 | 3 | 3 | 3 | 4 | 4 | 4 | 2 | 2 | 4 | 2 | 2 | 2 | 3 |

TABLE I-continued

| Test No. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| mould | | | | | | | | | | | | | | | | |
| Release agent left in the mould | — | 3 | 3 | 3 | 2 | 3 | 2 | 2 | 2 | 2 | 3 | 1 | 3 | 4 | 4 | 2 |
| Mould cleaning properties | 1 | 2 | 3 | 3 | 3 | 2 | 5 | 4 | 4 | 2 | 1 | 4 | 5 | 4 | 4 | 4 |
| Discolorations on concrete | 4 | 2 | 3 | 1 | 2 | 3 | 3 | 3 | 3 | 4 | 3 | 4 | 2 | 2 | 2 | 2 |
| Pores in concrete | 3 | 4 | 3 | 1 | 2 | 3 | 3 | 3 | 3 | 4 | 1 | 1 | 4 | 4 | 4 | 4 |
| Retardation of concrete | 5 | 1 | 1 | 5 | 3 | 3 | 3 | 3 | 3 | 3 | 4 | 4 | 1 | 2 | 2 | 2 |
| Suitable for painting | 5 | 2 | 2 | 2 | 3 | 3 | 2 | 3 | 3 | 4 | 4 | 5 | 2 | 2 | 2 | 3 |

"Mineral oil" is a spindle oil sold under the name Gulfpar 19.

TABLE IIa

| Test No. | 113 | | 115 | | 117 | | 118 | | 120 | |
|---|---|---|---|---|---|---|---|---|---|---|
| Composition: | | | | | | | | | | |
| Water | 47.6 | | 47.6 | | 47.6 | | 47.6 | | 47.6 | |
| Glycerol | 4 | | 4 | | 4 | | 4 | | 4 | |
| Propylene glycol | 4 | | 4 | | 4 | | 4 | | 4 | |
| Radia 7131[1] | 40 | | 40 | | 40 | | 40 | | 40 | |
| Stearic acid | 0.4 | | | | | | | | 0.4 | |
| Dimerised oleic/linoleic acid | | | 0.4 | | | | | | | |
| Gafac RE 410[2] | | | | | 0.4 | | | | | |
| Dodecylbenzene sulphonic acid | | | | | | | 0.4 | | | |
| Berol 26[3] | 4 | | 4 | | 4 | | 4 | | 4 | |
| $NH_3$ ad pH 8.5 | + | | + | | + | | + | | | |
| Monoethanolamine ad pH 9 | | | | | | | | | + | |
| Mould Material | S | P | S | P | S | P | S | P | S | P |
| Tilting angle, ° | 35 | 29 | 34 | 33 | 32 | 25 | 80 | 32 | 24 | 28 |
| Residual concrete in the mould | 5 | 5 | 3 | 1 | 3 | 2–3 | 1 | 1 | 5 | 5 |
| Release agent left in the mould | 1 | 1 | 1 | 2 | 1 | 1 | 1 | 1 | 1 | 1 |
| Mould cleaning properties | 5 | 5 | 4 | 4 | 3–4 | 5 | 4–5 | 4–5 | 5 | 5 |
| Discolorations on concrete | 5 | 5 | 4* | 3* | 5* | 5* | 1–2* | 1–2* | 5 | 5 |
| Pores in concrete | 4–5 | 4–5 | 5 | 4 | 5 | 5 | 3 | 3 | 5 | 5 |
| Retardation of concrete | 5 | 5 | 3 | 3 | 3 | 3 | 3 | 3 | 5 | 5 |
| Suitable for painting | 5 | 5 | 5 | 5 | 5 | 5 | 5 | 5 | 5 | 5 |

*Blotches in the edge owing to the fact that the release composition did not adhere sufficiently to the mould TABLE IIb

| Test No. | 119 | 127 | 128 | 129 | 134 |
|---|---|---|---|---|---|
| Composition: | | | | | |
| Water | 47.6 | 47.6 | 57.5 | 47.5 | 47.6 |
| Glycerol | 4 | 4 | 4 | 4 | 4 |
| Propylene glycol | 4 | 4 | 4 | 4 | 4 |
| Radia 7131[1] | 40 | | 30 | 40 | 20 |
| Risella oil 15 | | 40 | | | 20 |
| Berol 724 | 0.4 | | | | |
| Stearic acid | | 0.4 | 0.5 | | 0.4 |
| Crodacinic L[6] | | | | 0.5 | |
| Berol 26[3] | 4 | 4 | 4 | 4 | 4 |
| NaOH ad pH 9 | + | | | | |
| $NH_3$ ad pH 8.5 | | + | + | + | + |

TABLE IIb-continued

| Test No. | 119 | | 127 | | 128 | | 129 | | 134 | |
|---|---|---|---|---|---|---|---|---|---|---|
| Mould Material | S | P | S | P | S | P | S | P | S | P |
| Tilting angle, ° | 32 | 30 | 90 | 38 | 90 | 34 | 26 | 32 | 28 | 36 |
| Residual concrete in the mould | 3 | 3 | 4 | 4 | 4 | 4 | 4 | 2 | 3 | 4–5 |
| Release agent left in the mould | 1 | 1 | 4 | 3 | 3 | 2 | 1 | 2 | 3–4 | 1 |
| Mould cleaning properties | 4 | 4 | 1–2 | 3–4 | 3 | 4–5 | 3 | 4 | 2–3 | 4–5 |
| Discoloration on concrete | 3 | 3 | 5 | 5 | 5 | 4–5 | 2 | 2 | 4–5 | 5 |
| Pores in concrete | 4–5 | 5 | 4 | 4 | 5 | 4 | 3 | 2 | 4–5 | 4–5 |
| Retardation of concrete | 3 | 3 | 3–4 | 3–4 | 4 | 4 | 3 | 3 | 3 | 3 |
| Suitable for painting | | | 4 | 4 | 4 | 4 | 3 | 3 | 4 | 4 |

TABLE IIc

| Test No. | 166 | | 168 | | 169 | | 173 | | 175 | |
|---|---|---|---|---|---|---|---|---|---|---|
| Composition: | | | | | | | | | | |
| Water | 47.6 | | 47.5 | | 50.5 | | 49.5 | | 48.5 | |
| Glycerol | 4 | | 4 | | | | | | | |
| Propylene glycol | 4 | | 4 | | 5 | | 5 | | 5 | |
| Radia 7131[1] | 40 | | 40 | | 39.7 | | 39.7 | | 39.7 | |
| Berol 26[3] | 4 | | 2 | | 1 | | 1.5 | | 1.5 | |
| Berol 259[7] | | | | | 1 | | 1.5 | | 1.5 | |
| Grindtek Amos 90[8] | | | 2 | | 2 | | 2 | | 3 | |
| Stearic acid | 0.4 | | 0.5 | | 0.5 | | 0.5 | | 0.5 | |
| Imidazoline O[9] | | | 0.3 | | 0.3 | | 0.3 | | 0.3 | |
| $NH_3$ ad pH | 8.7 | | 9.1 | | 9.3 | | 9.3 | | 9.2 | |
| Viscosity (Emila) | 12 cP | | 10 cP | | 10 cP | | 10 cP | | 10 cP | |
| Mould Material | S | P | S | P | S | P | S | P | S | P |
| Tilting angle, ° | 90 | 74 | 28 | 55 | 33 | 31 | 35 | 40 | 30 | 35 |
| Residual concrete in the mould | 3 | 1 | 3 | 2–3 | 3–4 | 4–5 | 3–4 | 3–4 | 3–4 | 3–4 |
| Release agent left in the mould | 2 | 2 | 2 | 2–3 | 2 | 1 | 2 | 1 | 2 | 1 |
| Mould cleaning properties | 2 | 1 | 5 | 5 | 5 | 5 | 5 | 5 | 5 | 5 |
| Discoloration on concrete | 5 | 1 | 5 | 5 | 5 | 5 | 5 | 5 | 5 | 5 |
| Pores in concrete | 5 | 4 | 5 | 5 | 5 | 5 | 5 | 5 | 5 | 5 |
| Retardation of concrete | 4 | 4 | 2 | 2 | 2 | 2 | 2 | 2 | 2 | 2 |
| Suitable for painting | 5 | 5 | 5 | 5 | 5 | 5 | 5 | 5 | 5 | 5 |

[1]Radia 7131: Technical 2-ethylhexyl stearate (Oleofina)
[2]Gafac RE 410: Mono/diphosphoric acid ester (GAF)
[3]Berol 26: Poly (4) ethoxylated nonylphenol (Berol) (HLB: 8.9)
[4]Risella Oil: Paraffinic mineral oil (Shell) (viscosity at 40° C.: 15 cSt)
[5]Berol 724: Mixed phosphoric acid ester (Berol)
[6]Crodacinic L: N-lauryl sarcosine (Croda)
[7]Berol 259: Ethoxylated nonyl phenol (Berol) (HLB: 5.7)
[8]Grindtek Amos 90: Acetylated monoglyceride prepared from lard (Grindsted Products)
[9]Imidazoline O: 1-(2-Hydroxyethyl)-2-heptadecenyl-2-imidazoline (Protex)

The tests referred to in Tables IIa and IIb indicate that especially compositions containing 0.4–0.5% of stearic acid in the form of a salt have the most advantageous release properties.

From the results stated in Table IIa, obtained after a curing period of 17 hours, it appears that the addition of Grindtek Amos 90 and Imidazoline O has an advantageous effect on the release ability, and that a reduction in the contents of Berol 26 and glycerol (anti-freeze) apparently has an advantageous effect. A certain retardation of the concrete surface could be observed, but the surface appearance was good, and the residues in the mould were easily removable.

Retarding Effect

The retarding effect on concrete was determined as described above in TEST METHODS using the amounts stated below.

Table III shows the results obtained, i.e. the density of the concrete bodies formed, the bending strength and the compression strength, and furthermore indexes of bending strength and compressive strength, i.e. the result obtained stated as a percentage of the result obtained in a concrete body formed without a release agent.

The compositions were as follows:

Test No.

1: No agent added (reference test)
2: 2.5% of a mineral oil product
3: 5% of a mineral oil product
4: 10% of a mineral oil product
5: 5% of soy oil
6: 10% of soy oil
7: 5% of linseed oil
8: 10% linseed oil
9: 5% of isobutyl stearate
10: 10% of isobutyl stearate
11: No agent added (reference test)
12: 10% consisting of 50% of mineral oil (Gulfpar 19) and 50% of 2-ethyl-hexyl stearate
13: 20% consisting of 50% of mineral oil (Gulfpar 19) and 50% of 2-ethyl-hexyl stearate
14: 10% of a mineral oil mixture (consisting of 80% of spindle oil and 20% of kerosene)
15: 10% of a mineral oil mixture (consisting of 72 parts of spindle oil, 20 parts of kerosene and 8 parts of tall oil [retarding agent])
16: 10% of a mineral oil mixture (consisting of 80% paraffin oil and 20% of kerosene)
17: 10% of a mineral oil mixture (consisting of 72 parts of paraffin oil, 20 parts of kerosene and 8 parts of tall oil [retarding agent])
18: 10% ethyl-hexyl stearate
19: 10% consisting of 50% ethyl-hexyl stearate and 50% of paraffin mineral oil
20: 10% of 2-ethyl-hexyl oleate
21: 10% consisting of 50% ethyl-hexyl oleate and 50% mineral oil (Gulfpar 19)
22: =18
23: =21
24: 10% of isobutyl oleate
25: 10% of propylene glycol dioleate
26: 5% of methyl oleate

TABLE III

| Test No. | Days | Density kg/m$^2$ | Bending strength MN/m$^2$ | Compressive strength MN/m$^2$ | Bending index % | Compressive index % |
|---|---|---|---|---|---|---|
| 1 | 1 | 2203 | 4.75 | 21.50 | 100 | 100 |
| 2 | 1 | 2137 | 4.40 | 17.72 | 93 | 82 |
| 3 | 1 | 2132 | 4.20 | 15.60 | 88 | 73 |
| 4 | 1 | 2133 | 3.40 | 12.16 | 72 | 57 |
| 5 | 1 | 2137 | 3.10 | 11.07 | 65 | 51 |
| 6 | 1 | 2145 | 2.70 | 8.60 | 57 | 40 |
| 7 | 1 | 2148 | 2.30 | 8.11 | 48 | 38 |
| 8 | 1 | 2141 | 1.50 | 4.86 | 32 | 23 |
| 9 | 1 | 2129 | 3.80 | 14.07 | 80 | 65 |
| 10 | 1 | 2031 | 2.95 | 11.91 | 62 | 55 |
| 1 | 3 | 2250 | 6.60 | 39.07 | 100 | 100 |
| 2 | 3 | 2164 | 5.95 | 31.25 | 90 | 80 |
| 3 | 3 | 2164 | 6.00 | 27.51 | 91 | 70 |

TABLE III-continued

| Test No. | Days | Density kg/m$^2$ | Bending strength MN/m$^2$ | Compressive strength MN/m$^2$ | Bending index % | Compressive index % |
|---|---|---|---|---|---|---|
| 4 | 3 | 2148 | 5.40 | 23.47 | 82 | 60 |
| 5 | 3 | 2153 | 4.50 | 18.57 | 68 | 48 |
| 6 | 3 | 2164 | 3.60 | 13.16 | 55 | 34 |
| 7 | 3 | 2168 | 3.40 | 13.72 | 52 | 35 |
| 8 | 3 | 2180 | 1.90 | 6.66 | 29 | 17 |
| 9 | 3 | 2152 | 5.85 | 22.51 | 89 | 58 |
| 10 | 3 | 2043 | 4.20 | 20.07 | 64 | 51 |
| 1 | 7 | 2230 | 7.30 | 40.82 | 100 | 100 |
| 2 | 7 | 2172 | 6.70 | 32.32 | 92 | 80 |
| 3 | 7 | 2203 | 6.60 | 31.26 | 90 | 79 |
| 4 | 7 | 2164 | 5.85 | 26.63 | 80 | 65 |
| 5 | 7 | 2145 | 5.40 | 24.01 | 74 | 60 |
| 6 | 7 | 2164 | 3.85 | 15.44 | 53 | 39 |
| 7 | 7 | 2180 | 4.35 | 18.75 | 60 | 46 |
| 8 | 7 | 2195 | 2.35 | 8.63 | 32 | 22 |
| 9 | 7 | 2148 | 5.90 | 29.44 | 81 | 65 |
| 10 | 7 | 2074 | 4.80 | 24.82 | 66 | 63 |
| 11 | 2 | 2273 | 5.95 | 27.3 | 100 | 100 |
| | 3 | 2234 | 6.65 | 32.9 | 100 | 100 |
| | 5 | 2214 | 7.10 | 40.4 | 100 | 100 |
| | 7 | 2214 | 7.50 | 41.5 | 100 | 100 |
| | 14 | 2242 | 7.30 | 40.8 | 100 | 100 |
| | 28 | 2246 | 7.75 | 44.2 | 100 | 100 |
| 12 | 2 | 2188 | 5.80 | 20.2 | 97 | 74 |
| | 3 | 2184 | 5.70 | 25.1 | 86 | 76 |
| | 5 | 2125 | 5.40 | 27.6 | 76 | 68 |
| | 7 | 2211 | 6.20 | 31.0 | 83 | 75 |
| | 14 | 2164 | 6.50 | 31.9 | 89 | 78 |
| | 28 | 2188 | 6.80 | 32.8 | 88 | 74 |
| 13 | 2 | 2125 | 3.80 | 15.9 | 56 | 58 |
| | 3 | 2137 | 5.00 | 20.9 | 75 | 64 |
| | 5 | 2160 | 5.70 | 25.2 | 80 | 62 |
| | 7 | 2129 | 5.30 | 26.2 | 71 | 63 |
| | 14 | 2102 | 5.80 | 24.8 | 79 | 61 |
| | 28 | 2137 | 6.30 | 27.0 | 81 | 61 |
| 14 | 1 | 2137 | 4.10 | 14.0 | 86 | 65 |
| | 3 | 2148 | 6.20 | 30.0 | 93 | 91 |
| | 7 | 2152 | 6.60 | 31.5 | 88 | 76 |
| 15 | 1 | 2133 | 0.40 | 1.5 | 8 | 7 |
| | 3 | 2141 | 0.9 | 3.1 | 14 | 9 |
| | 7 | 2125 | 1.30 | 5.7 | 17 | 14 |
| 16 | 1 | 2184 | 4.00 | 14.0 | 84 | 65 |
| | 3 | 2184 | 6.30 | 29.8 | 95 | 91 |
| | 7 | 2168 | 7.00 | 31.7 | 93 | 76 |
| 17 | 1 | 2121 | 0,90 | 3.3 | 19 | 15 |
| | 3 | 2172 | 2.55 | 10.2 | 38 | 31 |
| | 7 | 2148 | 3.20 | 14.3 | 43 | 34 |
| 18 | 1 | 2172 | 3.15 | 11.5 | 66 | 53 |
| | 3 | 2164 | 5.65 | 27.2 | 85 | 83 |
| | 7 | 2187 | 5.55 | 29.4 | 74 | 71 |
| 19 | 1 | 2148 | 3.10 | 11.6 | 65 | 54 |
| | 3 | 2176 | 5.70 | 26.2 | 86 | 80 |
| | 7 | 2156 | 6.50 | 30.3 | 87 | 73 |
| 20 | 1 | 2148 | 3.00 | 11.1 | 63 | 52 |
| | 3 | 2195 | 6.10 | 23.8 | 92 | 72 |
| | 7 | 2168 | 6.60 | 27.8 | 88 | 67 |
| 21 | 1 | 2156 | 3.20 | 10.3 | 67 | 48 |
| | 3 | 2168 | 5.50 | 2.59 | 83 | 79 |
| | 7 | 2156 | 6.35 | 29.0 | 85 | 70 |
| 22 | 1 | 2152 | 2,90 | 10.3 | 61 | 48 |
| | 3 | 2184 | 5.40 | 24.3 | 81 | 74 |
| | 7 | 2199 | 6.45 | 30.9 | 86 | 74 |
| 23 | 1 | 2168 | 3.05 | 9.9 | 64 | 46 |
| | 3 | 2180 | 5.55 | 24.3 | 83 | 74 |
| | 7 | 2184 | 6.10 | 29.4 | 81 | 71 |
| 24 | 1 | 2160 | 3.9 | 15.2 | 82 | 71 |
| | 3 | 2140 | 5.6 | 27.4 | 85 | 83 |
| | 7 | 2168 | 5.9 | 29.1 | 79 | 70 |
| 25 | 1 | 2140 | 1.5 | 4.7 | 32 | 22 |
| | 3 | 2160 | 2.2 | 8.7 | 33 | 26 |
| | 7 | 2176 | 3.5 | 15.2 | 47 | 37 |
| 26 | 1 | 2125 | 0.7 | 2.8 | 15 | 13 |
| | 3 | 2172 | 1.9 | 7.0 | 29 | 21 |
| | 7 | 2145 | 2.3 | 8.3 | 31 | 20 |

The tests referred to above show that mineral oil per se has only a very slight retarding effect on concrete.

The addition of tall oil to mineral oil products imparts a strong retarding effect to the concrete. Isobutyl stearate, 2-ethylhexyl stearate and 2-ethylhexyl stearate have only a limited retarding effect. Vegetable oils (soy oil and especially linseed oil), propylene glycol dioleate and methyl oleate have a very strong retarding effect which in some cases will be too strong.

Biodegradability

Biodegradability determinations were performed on different concrete release agents with compositions as stated in tables IV, V and VI below. The determination of TOD values were carried out every second day for 28 consecutive days. Each determination was carried out in duplicate together with a reference test (in duplicate) and a blind test (in duplicate). In tables IV, V and VI mean values of the TOD determinations are stated.

TABLE IV

| | Biodegradability, % TOD | | | |
|---|---|---|---|---|
| Test No. | 3x | 6x | 4x | 5x |
| Emulsifier* | 4% | 4% | 4% | 4% |
| Spindle oil | 0% | 24% | 48% | 72% |
| Isobutyl stearate | 96% | 72% | 48% | 24% |
| Days | % TOD | % TOD | % TOD | % TOD |
| 2 | 10.5 | 9 | 10.5 | 7 |
| 4 | 27 | 20.5 | 20.5 | 11.5 |
| 6 | 39 | 29.5 | 26 | 12 |
| 8 | 50 | 39.5 | 31.5 | 16 |
| 10 | 60 | 46 | 36 | 21.5 |
| 12 | 63 | 46 | 36.5 | 22.5 |
| 14 | 67 | 48.5 | 40 | 25 |
| 16 | 71.5 | 51.5 | 45.5 | 29.5 |
| 18 | 74 | 54 | 47 | 32 |
| 20 | 75.5 | 55 | 47 | 33.5 |
| 22 | 76 | 56 | 49 | 34 |
| 24 | 80 | 58 | 51.5 | 37 |
| 26 | 80 | 59.5 | 51.5 | 36 |
| 28 | 81.5 | 61 | 52 | 37 |

*Low-ethoxylated nonylphenol

TABLE V

| Test No. | 4x | 7x | 8x | 9x |
|---|---|---|---|---|
| Emulsifier* | 4% | 4% | 4% | 4% |
| Spindle oil | 48% | | | 48% |
| White oil** | | | 48% | |
| Odourless white spirit | | 48% | | |
| Isobutyl stearate | 48% | 48% | 48% | |
| Soy oil | | | | 48% |
| Days | % TOD | % TOD | % TOD | % TOD |
| 2 | 7 | 7 | 7 | 6 |
| 4 | 16 | 16 | 17 | 14 |
| 6 | 23 | 22 | 23 | 19 |
| 8 | 28 | 28 | 29 | 23 |
| 10 | 31 | 33.5 | 34 | 25.5 |
| 12 | 33 | 38 | 38 | 28 |
| 14 | 34.5 | 43 | 40.5 | 28 |
| 16 | 35.5 | 46.5 | 43 | 29.5 |
| 18 | 36.5 | 50 | 46 | 30.5 |
| 20 | 37 | 52 | 48 | 31.5 |
| 22 | 38 | 52.5 | 49.5 | 33 |
| 24 | 39 | 54.5 | 50 | 34 |
| 26 | 41 | 56.5 | 51.5 | 35.5 |
| 28 | 42 | 57 | 51.5 | 36 |

*Low-ethoxylated nonylphenol
**White oil free from aromatic compounds

TABLE VI

| Test No. | 10x | 12x | 11x | 13x |
|---|---|---|---|---|
| Emulsifier* | 4% | 4% | 4% | 4% |
| White oil** | | 24% | 48% | 72% |
| 2-Ethylhexyl stearate | 96% | 72% | 48% | 24% |
| Days | % TOD | % TOD | % TOD | % TOD |

TABLE VI-continued

| Test No. | 10x | 12x | 11x | 13x |
|---|---|---|---|---|
| 2 | 8 | 6.5 | 10 | 6 |
| 4 | 20.5 | 18 | 20 | 11.5 |
| 6 | 28.5 | 23.5 | 23.5 | 12.5 |
| 8 | 33 | 25 | 25 | 12.5 |
| 10 | 40 | 30.5 | 29.5 | 17 |
| 12 | 44 | 35.5 | 34.5 | 19 |
| 14 | 45.5 | 35.5 | 33.5 | 18 |
| 16 | 51 | 39 | 35.5 | 20 |
| 18 | 56.5 | 42 | 38 | 23.5 |
| 20 | 57 | 41 | 36.5 | 22.5 |
| 22 | 59 | 42 | 37.5 | 24 |
| 24 | 62.5 | 43 | 39 | 28 |
| 26 | 64 | 42.5 | 38.5 | 28.5 |
| 28 | 64.5 | 44 | 39 | 29 |

*Low-ethoxylated nonylphenol
**White oil free from aromatic compounds

Compositions with a high content of synthetic esters of aliphatic carboxylic acids are more bio-degradable than compositions with a high content of mineral oils, and as appears from table III, the compositions with synthetic esters have advantageous properties with respect to retarding effects.

Viscosity

Viscosity measurements were performed as described under TEST METHODS above on mixtures of natural vegetable oils with synthetic esters and on water-in-oil emulsions in which the oily phases were natural vegetable oils, optionally in admixture with mineral oils. The compositions and results appear from the tables below.

| | | | | | | | | | |
|---|---|---|---|---|---|---|---|---|---|
| Rape oil, % | 100 | 95 | 90 | 80 | 70 | 60 | 40 | 20 | 0 |
| 2-Ethyl-hexyl ester*, % | 0 | 5 | 10 | 20 | 30 | 40 | 60 | 80 | 100 |
| Viscosity, cP | 65 | 62 | 51 | 42 | 35 | 30 | 22 | 15 | 11 |
| Soy oil, % | 100 | 95 | 90 | 80 | 70 | 60 | 40 | 20 | 0 |
| 2-Ethyl-hexyl ester, % | 0 | 5 | 10 | 20 | 30 | 40 | 60 | 80 | 100 |
| Viscosity, cP | 45 | 41 | 38 | 34 | 29 | 25 | 19 | 14 | 11 |

| Water-in-oil emulsions | | | | | |
|---|---|---|---|---|---|
| 1. | | | | | |
| Oily phase: | | | | | |
| 2-Ethyl-hexyl palmitate | 18.4% | 23% | 27.6% | 32.2% | 36.8% |
| Rape oil | | | | | |
| Purified mineral oil (Gulfpar 19) | 18.4% | 23% | 27.6% | 32.2% | 36.8% |
| Non-ionic emulsifier (HLB = 3) | 2.8% | 3.5% | 4.2% | 4.9% | 5.6% |
| Triethanolamine-oleic acid ester | 0.4% | 0.5% | 0.6% | 0.7% | 0.8% |
| Aqueous phase: | | | | | |
| Tap water | 58.5% | 49% | 39.2% | 29.4% | 19.6% |
| $MgSO_4$ | 0.6% | 0.5% | 0.4% | 0.3% | 0.2% |
| 40% acrylate solution | 0.6% | 0.5% | 0.4% | 0.3% | 0.2% |
| Viscosity, cP | 475 | 210 | 130 | 80 | 55 |
| 2. | | | | | |
| Oily phase: | | | | | |
| 2-Ethyl-hexyl palmitate | | | | | |
| Rape oil | 18.4% | 23% | 27.6% | 32.2% | 36.8% |
| Purified mineral oil (Gulfpar 19) | 18.4% | 23% | 27.6% | 32.2% | 36.8% |
| Non-ionic emulsifier (HLB = 3) | 2.8% | 3.5% | 4.2% | 4.9% | 5.6% |
| Triethanolamine oleic acid ester | 0.4% | 0.5% | 0.6% | 0.7% | 0.8% |
| Aqueous phase: | | | | | |
| Tap water | 58.8% | 49% | 39.2% | 29.4% | 19.6% |
| $MgSO_4$ | 0.6% | 0.5% | 0.4% | 0.3% | 0.2% |
| 40% acrylate so- | 0.6% | 0.5% | 0.4% | 0.3% | 0.2% |

-continued

| | | | | | |
|---|---|---|---|---|---|
| lution | | | | | |
| Viscosity, cP | >1000 | 360 | 260 | 185 | 150 |
| 3. | | | | | |
| Oily phase: | | | | | |
| 2-Ethyl-hexyl palmitate | 23% | 18.4% | 13.8% | 9.2% | 4.6% |
| Rape oil | 4.6% | 9.2% | 13.8% | 18.4% | 23% |
| Purified mineral oil (Gulfpar 19) | 27.6% | 27.6% | 27.6% | 27.6% | 27.6% |
| Non-ionic emulsifier (HLB = 3) | 4.2% | 4.2% | 4.2% | 4.2% | 4.2% |
| Triethanolamine oleic acid ester | 0.6% | 0.6% | 0.6% | 0.6% | 0.6% |
| Aqueous phase: | | | | | |
| Tap water | 39.2% | 39.2% | 39.2% | 39.2% | 39.2% |
| $MgSO_4$ | 0.4% | 0.4% | 0.4% | 0.4% | 0.4% |
| 40% acrylate solution | 0.4% | 0.4% | 0.4% | 0.4% | 0.4% |
| Viscosity, cP | 155 | 175 | 215 | 225 | 370 |

*The ester was prepared from an acid mixture consisting of:
Stearic acid: 32%
Palmitic acid: 51%
Myristic acid: 14%
Lauric acid: 3%

It appears from the tables that as little as 10% of synthetic ester added to a natural vegetable oil gives a considerable decrease in viscosity, and that as little as 5% (calculated on the total content) in the emulsified systems gives an advantageous decrease in viscosity.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method for improving the release of a molded concrete body from a mold, comprising applying to the mold an effective amount of an oil-in-water emulsion having a pH of 7.4–10.5 and a viscosity below 40 cp at 40° C. as determined by an Emila viscosimeter, and containing 20–80% by weight of water, calculated on the total emulsion;

15–75% by weight, calculated on the total emulsion, of an oily component selected from the group consisting of mineral oils, triglycerides and esters of aliphatic carboxylic acids with mono- or dihydric alcohols, the total number of carbon atoms in the esters ranging from 8 to 46 and said esters having melting points below 25° C.;

1–12% by weight, calculated on the total emulsion, of at least one non-ionic surfactant having a HLB value of at the most 9.9; and 1–100% by weight, calculated on the amount of non-ionic surfactant, of at least one anionic surfactant provided as a salt selected from the group consisting of sodium, potassium, lithium, ammonium, lower alkylamine, lower alkylalkanolamine, and lower alkanolamine salts having up to 8 carbon atoms of phosphate esters and carboxylic acids, or provided as a mixed salt thereof;

and after application, said oil-in-water emulsion is converted into an oily film or a water-in-oil emulsion.

2. The method according to claim 1, wherein the anionic surfactant is a member selected from the group consisting of salts of mono- and diphosphoric acid esters of ethoxylated $C_{4-15}$ alkyl- and di-$C_{2-15}$ alkylphenols and ethoxylated fatty $C_{8-22}$ alcohols, $C_{8-22}$ alkylsarcosines, $C_{1-15}$ alkylphenylcarboxylic acids, arylcarboxylic acids, aryl-$C_{1-15}$ alkylcarboxylic acids, $C_{1-15}$ alkylaryl-$C_{1-15}$ alkyl carboxylic acids, phenoxy-$C_{1-15}$ alkylcarboxylic acids, $C_{1-15}$ alkylphenoxy-C1-15 alkylcarboxylic acids, $C_{8-30}$ alkylcarboxylic acids and the corresponding dicarboxylic acids and the corresponding unsaturated analogues thereof and salts of unsaturated dimerised or trimerised fatty acids.

3. The method according to claim 1, wherein the total amount of non-ionic surfactant(s) is 1–12% by weight of the total emulsion.

4. The method according to claim 1, wherein the non-ionic surfactant(s) is/are selected from the group consisting of ethoxylated, propoxylated and the co-ethoxylated/propoxylated non-ionic surfactants, monoglycerides of saturated and unsaturated $C_{8-24}$ fatty acids, and mono- or di-($C_{1-4}$)-acylated monoglycerides of $C_{2-24}$ fatty acids.

5. The method according to claim 1, wherein the non-ionic surfactant(s) is/are selected from the group consisting of ethoxylated, propoxylated and co-ethoxylated/propoxylated non-ionic surfactants.

6. The method according to claim 1, wherein the emulsion further comprises a cationic surfactant and the molecule of which comprises a hydrophobic part with at least 10 carbon atoms, in an amount of at the most 60%, calculated on the molar amount of the anionic surfactant.

7. The method according to claim 6, wherein the cationic surfactant is selected from the group consisting of mono-, di- and trivalent alkylamines, and ethoxylated amines, quaternary ammonium compounds, and ampholytes.

8. The method according to claim 1, wherein the emulsion further comprises at least one member selected from the group consisting of: stabilizers, anti-freeze agents, corrosion-inhibitors, and hydrophobicity-imparting agents.

9. The method according to claim 6, wherein the emulsion further comprises the cationic surfactant and an anionic surfactant selected from the group consisting of $C_{8-22}$ alkyl or $C_{8-22}$ alkenyl sarcosines, $C_{6-20}$ alkyl or $C_{6-20}$ alkenyl succinic acids, $C_{6-20}$ alkyl or $C_{6-20}$ alkenylphenoxyacetic acid, $C_{8-22}$ alkylsulfamido carboxylic acid, $C_{1-10}$ alkylarylsulfamido carboxylic acid and arylsulfamido carboxylic acid, the total amount of anionic surfactant being 0.5–20% by weight based on the total weight of the composition, and the amount of the cationic surfactant being 5–150%, calculated on the basis of the molar amount of the anionic surfactant present in the emulsion.

10. The method of claim 3, wherein said fatty acids carry a hydroxy group.

11. The method of claim 1, wherein the pH is in the range of 7.8–10.

12. The method of claim 10, wherein the pH is in the range of 8.2–9.5.

13. The method of claim 1, wherein the water has a hardness of 2°–75° d.

14. The method of claim 1, wherein the viscosity of the emulsion at 20° C. is below 60 cP as determined by an Emila viscosimeter.

15. The method according to claim 1, wherein the emulsion further comprises at least one member of the group consisting of glycols, lower polyglycols and glycol ethers at an amount of 1–20% by weight of the total emulsion.

16. The method according to claim 13, wherein the emulsion comprises propylene glycol and/or glycerol.

17. The method according to claim 1, wherein the oily component is an ester of an aliphatic carboxylic acid with a mono- or dihydric alcohol.

18. The method according to claim 1, wherein the amount of the anionic surfactant in relation to the amount of the non-ionic surfactant is 2–50% by weight.

19. The method according to claim 1, wherein the anionic surfactant is a salt of a saturated $C_{12-30}$ acid.

20. The method according to claim 1, wherein the amount of oily component is 25–55% by weight of the total emulsion.

21. The method according to claim 4, wherein the ethoxylated surfactant(s) is/are selected from the group consisting of ethoxylated nonylphenol, ethoxylated dinonylphenol, ethoxylated $C_{8-22}$ fatty alcohols and $C_{10-22}$ fatty acid polyethylene glycol esters.

22. The method for improving the release of a molded concrete body from a mold, comprising preparing an oil-in-water emulsion as defined in claim 1, by adding water to an emulsion concentrate comprising all the constituents of the final oil-in-water emulsion except for the water, applying to the mold an effective amount of the oil-in-water emulsion, and after application, said oil-in-water emulsion is converted into an oily film or a water-in-oil emulsion.

23. A method for improving the release of a molded concrete body from a mold, comprising applying to the mold an effective amount of an oil-in-water emulsion having a pH of 7.4–10.5 and a viscosity below 40 cp at 40° C. as determined by means of an Emila Viscosimeter, and containing 20–80% by weight of water, calculated on the total emulsion;

15–75% by weight, calculated on the total emulsion, of an oil component selected from the group consisting of esters of aliphatic carboxylic acids with mono- or dihydric alcohols, the total number of carbon atoms in the esters ranging from 8 to 46 and said esters having melting points below 25° C.;

1–12% by weight, calculated on the total emulsion, of at least one non-ionic surfactant having a HLB value of at the most 9.9; and 1–100% by weight, calculated on the amount of non-ionic surfactant, of at least one anionic surfactant provided a salt selected from the group consisting of sodium, potassium, lithium, ammonium, lower alkylamine, lower alkyl-alkanolamine, and lower alkanolamine salts having up to 8 carbon atoms of phosphate esters and carboxylic acids, or provided as a mixed salt thereof;

and after application, said oil-in-water emulsion is converted into an oily film or a water-in-oil emulsion.

24. A method for improving the release of a molded concrete body from a mold comprising applying to the mold an effective amount of a composition comprising at least one oily ester of an aliphatic carboxylic acid with a mono- or dihydric alcohol, the ester having a melting point of at most 35° C., the total number of carbon atoms in the ester being 8–46, in an amount of 26–100% by weight, calculated on the total composition.

25. The method according to claim 23, wherein the alcohol moiety is derived from a monoalcohol of the formula I or II $$R_1OH \qquad \text{I}$$

$$R_2O—R_3—OH \qquad \text{II}$$

in which $R_1$ and $R_2$ are each a straight or branched, saturated or unsaturated hydrocarbyl group of 1–22 carbon atoms, and $R_3$ is a straight or branched, saturated or unsaturated hydrocarbylene chain of 2–22 carbon atoms, and the total number of carbon atoms in $R_2$ and $R_3$ is at the most 24.

26. The method according to claim 23, wherein the acid moiety of the ester is derived from an aliphatic monocarboxylic acid of the formula $R_4COOH$ in which $R_4$ is a straight or branched, saturated or unsaturated hydrocarbyl group of 1–30 carbon atoms which is optionally substituted for one or several hydroxy groups.

27. The method according to claim 26, wherein $R_4$ is a straight or branched saturated or unsaturated hydrocarbyl group of 8–20 carbon atoms which is optionally substituted for one or several hydroxy groups.

28. The method according to claim 26, wherein the hydrocarbyl group $R_4$ is substituted with one or several hydroxy groups.

29. The method according to claim 26, wherein the hydrocarbyl group $R_4$ is substituted with one or several hydroxy groups.

30. The method according to claim 25, wherein the acid moiety is derived from a saturated carboxylic acid.

31. A method for improving the release of a molded concrete body from a mold, comprising applying to the mold an effective amount of an oil-in-water emulsion having a pH of 7.4–10.5 and a viscosity below 40 cp at 40° C. as determined by an Emila viscosimeter, and containing 20–80% by weight of water, calculated on the total emulsion;

10–40% by weight, calculated on the total emulsion, of an oily component selected from the group consisting of mineral oils, triglycerides and esters of aliphatic carboxylic acids with mono- or dihydric alcohols, the total number of carbon atoms in the esters ranging from 8 to 46 and said esters having melting points below 25° C.;

1–12% by weight, calculated on the total emulsion, of at least one non-ionic surfactant having a HLB value of at the most 9.9; and 1–100% by weight, calculated on the amount of non-ionic surfactant, of at least one anionic surfactant provided as a salt selected from the group consisting of sodium, potassium, lithium, ammonium, lower alkylamine, lower alkylalkanolamine, and lower alkanolamine salts having up to 8 carbon atoms of phosphate esters and carboxylic acids, or provided as a mixed salt thereof;

and after application, said oil-in-water emulsion is converted into an oily film or a water-in-oil emulsion.

32. A method for improving the release of a molded concrete body from a mold, comprising applying to the mold an effective amount of an oil-in-water emulsion having a pH of 7.4–10.5 and a viscosity below 40 cp at 40° C. as determined by means of an Emila Viscosimeter, and containing 20–80% by weight of water, calculated on the total emulsion;

10–40% by weight, calculated on the total emulsion, of an oil component selected from the group consisting of esters of aliphatic carboxylic acids with mono- or dihydric alcohols, the total number of carbon atoms in the esters ranging from 8 to 46 and said esters having melting points below 25° C.;

1–12% by weight, calculated on the total emulsion, of at least one non-ionic surfactant having a HLB value of at the most 9.9; and 1–100% by weight, calculated on the amount of non-ionic surfactant, of at least one anionic surfactant provided a salt selected from the group consisting of sodium, potassium, lithium, ammonium, lower alkylamine, lower alkyl-alkanolamine, and lower alkanolamine salts having up to 8 carbon atoms of phosphate esters and carboxylic acids, or provided as a mixed salt thereof;

and after application, said oil-in-water emulsion is converted into an oily film or a water-in-oil emulsion.

* * * * *